US005339970A

United States Patent [19]

Mautino et al.

[11] Patent Number: 5,339,970

[45] Date of Patent: * Aug. 23, 1994

[54] SLACKLESS DRAWBAR ASSEMBLY EMPLOYING ADJUSTABLE BLOCKOUT APPARATUS

[75] Inventors: Peter S. Mautino, Verona; Douglas M. Hanes, Pittsburgh, both of Pa.

[73] Assignee: McConway & Torley Corporation, Pittsburgh, Pa.

[ * ] Notice: The portion of the term of this patent subsequent to Dec. 22, 2009 has been disclaimed.

[21] Appl. No.: 986,530

[22] Filed: Dec. 7, 1992

[51] Int. Cl.[5] ..... B61G 9/00

[52] U.S. Cl. ..... 213/67 R

[58] Field of Search ..... 213/67 R, 67 A, 68, 213/69, 70, 71, 72, 75 R, 50, 56, 61, 62 R, 64

[56] References Cited

U.S. PATENT DOCUMENTS

| | | | |
|---|---|---|---|
| 1,545,521 | 7/1925 | Richardson | 213/67 R |
| 2,241,353 | 5/1941 | Kinne et al. | 213/67 R X |
| 2,452,015 | 10/1948 | Kinne et al. | 213/67 R |
| 4,456,133 | 6/1984 | Altherr et al. | 213/62 R |
| 4,531,648 | 7/1985 | Paton | 213/50 |
| 4,555,033 | 11/1985 | Miller | 213/51 |
| 4,580,686 | 4/1986 | Elliott | 213/62 A |
| 4,700,853 | 10/1987 | Atherr et al. | 213/50 |
| 4,846,358 | 7/1989 | Rhen | 213/64 |
| 5,172,818 | 12/1992 | Mautino et al. | 213/62 R |
| 5,190,173 | 3/1993 | Mautino et al. | 213/62 R |
| 5,221,015 | 6/1993 | Mautino et al. | 213/67 R |

*Primary Examiner*—Robert J. Oberleitner

*Assistant Examiner*—Kevin D. Rutherford

*Attorney, Agent, or Firm*—James Ray & Associates

[57] ABSTRACT

There is provided a slackless drawbar assembly which connects the adjacent ends of a pair of railway cars together in a substantially semi-permanent fashion. The assembly includes a yoke, an adjustable blockout apparatus which has a pair of spaced end blocks and an adjustable securing device which comprises a pair of spaced wedge members. There are outwardly extending flanges on the confronting end faces of the end blocks which engage tongues or tenons on the end walls of the spaced wedge members. The adjustable securing device comprises coaxial bores through the spaced wedge members and a threaded member extending between and through the coaxial bores and threadably engaged with threads formed in at least one of the bores such that upon rotating the threaded member in one direction, the spaced wedge members will be moved together, to push the pair of end blocks apart, while upon rotating the threaded member in the other direction, the spaced wedge members will be moved apart to pull together the pair of spaced end blocks. A preferred yoke includes a rear end portion which has a front face that forms a rear seat for a blockout device. There are a top strap portion and a bottom strap portion extending forwardly of the front face of such rear end portion of the yoke. Each of such top and bottom strap portions includes a thickened portion, at its end remote from such rear end portion of the yoke, which has a bore therethrough to receive an end of a drawbar connecting pin to connect the yoke to a drawbar.

19 Claims, 8 Drawing Sheets

SLACKLESS DRAWBAR ASSEMBLY EMPLOYING ADJUSTABLE BLOCKOUT APPARATUS

RELATED PATENT APPLICATIONS

This application is related to the following previously filed patent applications assigned to the same assignee as herein:

Ser. No. 07/826,797 filed Jan. 28, 1992 for "Adjustable Securing Device, now U.S. Pat. No. 5,172,818;

Ser. No. 07/826,627 filed Jan. 28, 1992 for "An Adjustable Blockout Apparatus, now U.S. Pat. No. 5,190,173; and Ser. No. 07/827,149 filed Jan. 28, 1992 for "Yoke for Coupling Railway Cars Utilizing a Drawbar Assembly"now U.S. Pat. No. 5,221,015.

The teaching of each of said related applications is specifically incorporated herein and made a part hereof by this reference thereto.

FIELD OF THE INVENTION

The present invention relates to a slackless drawbar assembly for connecting adjacent ends of a pair of railway cars together in a substantially semi-permanent manner and especially to such an assembly which employs an adjustable blockout apparatus for eliminating slack between the elements of the drawbar assembly and specifically to such an assembly which utilizes a yoke having a pocket to receive such adjustable blockout apparatus.

BACKGROUND OF THE INVENTION

The railroad locomotives used in the railroad industry prior to the introduction of the more powerful and efficient diesel engine in such locomotives, were in most cases generally underpowered. Therefore, it was usually necessary to provide each end of a railway freight with a draft gear assembly. This was required in order for these underpowered locomotives to start a train consist, having a number of cars, in motion. As is known in the railway art, these draft gear assemblies were used to provide a requisite amount of slack in the coupling arrangement between the adjacent ends of several such freight cars making up the train consist. This slack, as is generally well known in the railway art, enabled start-up movement of the lead car and, thereafter, each of the following cars in succession. In other words, during start-up of the train consist the locomotive would begin taking up the slack between it and the lead car first. Thereafter the available slack in each following car, in turn, would be taken up. This start-up procedure enabled the generally lower powered locomotive to gain sufficient initial momentum to start the train consist in motion.

Furthermore, in the railway art, it is equally well known that at least a portion of the buff and draft forces which are generated and then applied to the railroad freight cars in such a coupling arrangement, during in-track operation of the train consist, were normally absorbed by these draft gear assemblies- It is con, non practice in this type of coupling arrangement for such draft gear assemblies to be mounted in a draft gear pocket located in a yoke disposed within the center sill member of the railway freight car. The yoke is connected to the railway car coupler mechanism by means of a striker plate casting.

These prior art type coupling arrangements did not absorb or avoid all of the dynamic loading which occurred in a train and the portion which remained resulted in detrimental dynamic loading on both the car body members and their contents. This dynamic loading almost always results in considerable wear of the various components of the coupling mechanism disposed on the freight car and depending upon the contents being transported by such freight car such dynamic loading can even result in damage to such contents. It is obvious that wear of the various coupling components will require considerable maintenance to be carried out so that the car can remain in service. It is further obvious that such maintenance is costly.

However, since the introduction of the more powerful diesel locomotive, in the modern railroad industry, it has been discovered that the slack formerly required in the older style coupling arrangements is no longer necessary to start the train consist in motion. A diesel locomotive, in other words, provides the capability of starting the movement of a train consist containing multiple freight cars without the need for considerable amounts of slack being provided by the draft gear assemblies of the prior art car coupling arrangements. As a result, slackless drawbar assemblies have generally come into widespread use in the railroad industry as the coupling arrangement for joining together the adjacent ends of a pair of railway freight cars in a substantially semi-permanent manner. It has been demonstrated that these slackless drawbar assemblies enable the buff and draft forces which are generated by in-track movement to be distributed through the car center sill member to all of the railway cars making up such train consist with less damage to both the freight car components and cargo.

SUMMARY OF THE INVENTION

The present invention provides a slackless drawbar assembly for connecting together the adjacent ends of a pair of railway cars in a substantially semi-permanent manner wherein the assembly employs an axially adjustable blockout apparatus to eliminate slack between the elements of the drawbar assembly. In a preferred form the drawbar assembly includes an improved yoke to be used with the blockout apparatus, thus forming an overall assembly designed to take advantage of the characteristics of a drawbar type of coupling between railway cars.

The present invention provides a slackless drawbar assembly which connects the adjacent ends of a pair of railway freight cars together in a substantially semi-permanent fashion and employs an axially adjustable blockout apparatus positionable within the draft gear pocket of a yoke disposed within a center sill member of a railway car body. In a preferred form the present invention also employs an improved yoke which has a pocket for receiving a slack take-up device, such as the adjustable blockout apparatus, for use on a railway car equipped with a slackless drawbar coupling arrangement.

The adjustable blockout apparatus has a pair of spaced end blocks and a pair of spaced wedge members, with the spaced wedge members being slidably connected to the spaced end blocks and with an adjustable device being provided to secure the pair of spaced wedge members together. The spaced end blocks each have a top wall, a bottom wall, a pair of end walls, a pair of side walls, and confronting end faces. The confronting end faces have an inclined surface along at least a portion thereof which extends from a respective top or bottom wall of each of the pair of end blocks towards an intermediate section thereof. The pair of spaced wedge members, which are slidably disposed between the spaced end blocks, each have a pair of side walls, an outer wall, an inner wall which confronts the inner wall of the other wedge member, and a pair of end walls which extend from the outer wall to the inner wall and which converge toward each other as they extend from the outer wall to the inner wall. An adjustable securing device adjustably secures the confronting pair of spaced wedge members together, while the spaced wedge members are also slidably connected to the pair of end blocks, with the converging end walls of the spaced wedge members contacting a respective inclined surface of a respective confronting end face of an end block. The slidable connection between the pair of spaced wedge members and the pair of spaced end blocks is preferably effected by means of outwardly extending flanges on the confronting end faces of the end blocks and a tongue or tenon provided on the end walls of the spaced wedge members and terminating in a key member at each end. The flanges and the inclined surfaces of the confronting end faces of the end blocks forming a mortise and the tongues or tenons with their associated key members forming a tenon of a mortise and tenon connection between the end blocks and the spaced wedge members. The adjustable securing device for securing the pair of spaced wedge members together comprises coaxial threaded bores through the spaced wedge members and a threaded member extending between and through the coaxial bores and threadably engaged therewith. The bores are threaded in opposite directions and the threaded member has a threaded portion adjacent each end which is threadable with the bores, such that upon rotating the threaded member in one direction, the spaced wedge members will be moved together, to push the pair of end blocks apart, while upon rotating the threaded member in the other direction, the spaced wedge members will be moved apart to pull the pair of spaced end blocks together.

In an alternative form of adjustable securing device, only one of the spaced wedge members has a threaded bore and the threaded member has threads of one hand only to match and engage the threads of such threaded bore in the one spaced wedge member. The other spaced wedge member has an enlarged bore therethrough coaxial with the threaded bore in the one spaced wedge member. The diameter of the enlarged bore is greater than the major diameter of the threaded member to allow relatively free passage of the threaded member through the enlarged bore. A bolt head or the like on one end of the threaded member is used to retain the other wedge shaped member relative to the one wedge shaped member. When the threaded member is rotated in one direction the bolt head will move farther away from the one spaced wedge member making it possible for the other spaced wedge member to be positioned farther from the one spaced wedge member, which action allows the spaced end blocks to move closer together. When the threaded member is rotated in the other direction the spaced wedge members are drawn closer together forcing the spaced end blocks away from each other and increasing the overall length of the blockout apparatus. Expansion coil springs are positioned between the spaced wedge members to urge such spaced wedge members apart from each other to the extent permitted by the position of the threaded member. Elongated spring retainer posts are attached to the opposed surfaces of the spaced wedge members. The spring retainer posts may be arranged in axially aligned opposed pairs and fit closely within the inner diameter of the springs to help hold them in place and in axial alignment.

A preferred yoke includes a rear end portion which has a front face that forms a rear seat for a blockout device. There is a top strap portion having a first end thereof connected to a first end of such rear end portion, the top strap portion extending forwardly of the front face of such rear end portion of the yoke for a first predetermined length. Further, a bottom strap portion has a first end thereof connected to a second end of such rear end portion of the yoke radially opposed to the first end of such rear end portion. This bottom strap portion extends forwardly of the front face of the rear end portion of such yoke for a second predetermined length. Such yoke also has a top forward portion, a first end of which is connected to a second end of the top strap portion radially opposed to the first end thereof. Such top forward portion of the yoke includes a portion thereof which is thicker than a predetermined thickness of the top strap portion radially opposed to the first end of the top forward portion of the yoke. There is also a bottom forward portion having a first end thereof connected to a second end of such bottom strap portion radially opposed to the first end thereof. The bottom forward portion also includes a portion thereof that is thicker than a predetermined thickness of the bottom strap portion. Each of such top forward portion and such bottom forward portion of the yoke terminates in a reduced thickness nose portion. Each of the reduced thickness nose portions has an outer surface disposed substantially parallel to a longitudinal centerline of the yoke and an inner surface inclined outwardly of such longitudinal centerline. A first generally round aperture is formed through such portion of the top forward portion which is thicker than a predetermined thickness of such top strap portion. This first generally round aperture has a predetermined diameter. Received in the first generally round aperture is a first portion of a drawbar connecting pin. In addition, a second generally round aperture is formed through such portion of the bottom forward portion which is thicker than such predetermined thickness of the bottom strap portion. This second generally round aperture has a predetermined diameter. The second generally round aperture receives therein a second portion of such drawbar connecting pin radially opposed to such first portion of the drawbar connecting pin. There is a first side post member connected at a first end thereof to an inner surface of such top strap portion adjacent a first outer edge thereof and intermediate the first and the second ends thereof and connected at a radially opposed second end thereof to an inner surface of such bottom strap portion adjacent a first outer edge thereof and intermediate the first and the second ends thereof. A second side post member is positioned radially opposite the first side post member. This second side post member is connected at a first end thereof to the inner surface of the top strap portion adjacent a second outer edge thereof and is connected at a radially opposed second end thereof to the inner surface of such bottom strap portion adjacent a second outer edge thereof- Finally, an aperture is formed through at least one of the top strap portion and the bottom strap portion for receiving therein an adjusting means used to adjust a length of an axially adjustable blockout device when such adjustable blockout device is mounted within a yoke pocket defined by the front face of such rear end portion, the inner surface of the top strap portion and the inner surface of such bottom strap portion and an inner surface of each of the first and the second side post members.

The invention discloses in another aspect a slackless drawbar assembly for connecting adjacent ends of a pair of railway cars together in a substantially semi-permanent manner which assembly comprises a yoke and a yoke draft gear pocket axially adjustable blockout apparatus. The yoke is characterized by a rear end portion having a front face which forths a rear seat for a blockout device; a top strap portion having a first end thereof connected to a first end of the rear end portion, the top strap portion extending forwardly of the front face of the rear end portion of the yoke for a first predetermined length; a bottom strap portion having a first end connected to a radially opposed second end of the rear end portion, the bottom strap portion extending forwardly of the front face of the rear end portion of the yoke for a second predetermined length; a top forward portion having a first end thereof connected to a radially opposed second end of the top strap portion, the top forward portion having a portion thereof which is thicker by a predetermined amount than a predetermined thickness of the top strap portion; a bottom forward portion having a first end thereof connected to a radially opposed second end of the bottom strap portion, the bottom forward portion having a portion thereof which is thicker by a predetermined amount than a predetermined thickness of the bottom strap portion, each of the top forward portion and the bottom forward portion of the yoke terminating in a reduced thickness nose portion, the nose portion having an outer surface substantially parallel to a longitudinal centerline of the yoke and an inner surface inclined outwardly of such longitudinal centerline.

A first generally round aperture is formed through the portion of the top forward portion which is thicker than the predetermined thickness of the top strap portion, the first such generally round aperture having a predetermined diameter for receiving therein a first portion of a drawbar connecting pin member; and a second generally round aperture is formed through the portion of the bottom forward portion which is thicker than the predetermined thickness of the bottom strap portion, the second generally round aperture having a predetermined diameter for receiving therein a second radially opposed portion of such drawbar connecting pin member.

A first side post member is connected at a first end thereof to an inner surface of the top strap portion adjacent an outermost outer edge thereof and intermediate the first and second ends of the top strap portion and connected at a radially opposed second end thereof to an inner surface of the bottom strap portion adjacent a first outermost edge thereof and intermediate the first and second ends thereof of the bottom strap portion; and a second side post member is positioned radially opposite the first side post member, such second side post member being connected at a first end thereof to the inner surface of the top strap portion adjacent a second outermost edge thereof and connected at a radially opposed second end thereof to the inner surface of the bottom strap portion adjacent a second outermost edge thereof; each of the top strap member and the bottom strap member having a first tapered portion extending inwardly toward a vertical plane extending through a longitudinal centerline of the yoke beginning at a point adjacent a first edge of a respective one of the first and second side post members which faces the front face of the rear portion of the yoke and ending at a predetermined point adjacent the front face of the rear portion of the yoke.

Each of the top strap member and the bottom strap member has a second tapered portion extending inwardly toward a vertical plane extending through the longitudinal centerline of the yoke beginning at a point adjacent a second edge of the respective one of the first and second side post members which faces a respective one of the forward portion of such top strap member and such bottom strap member and ending at a point adjacent the portion thereof which is thicker.

An outer edge of each of the top strap member and the bottom strap member is disposed between the first edge and the second edge of a respective one of the first and second side post members being in a plane disposed substantially parallel to the vertical plane extending through the longitudinal centerline of the yoke. The yoke has an aperture at an area spaced from the front face of the rear end portion formed through at least one of the top strap portion and the bottom strap portion at a point located between the front face of the rear end portion and the location of the first and second side post members for providing access to an adjusting means to adjust an axial length of an adjustable blockout device when such adjustable blockout device is mounted within a yoke pocket defined by the front face of the rear end portion, the inner surface of the top strap portion, the inner surface of the bottom strap portion and an inner surface of each of the first side post member and the second side post member.

The rear end portion and the first and second side post members provide the only connections between the top strap portion and the bottom strap portion of the yoke.

The yoke draft gear pocket axially adjustable blockout apparatus is positioned within the yoke pocket defined by the front face of the rear end portion, the inner surface of the top strap portion, the inner surface of the bottom strap portion and an inner surface of each of the first side post member and the second side post member.

The invention discloses in another aspect a slackless drawbar assembly for connecting adjacent ends of a pair of railway cars together in a substantially semi-permanent manner, which assembly comprises a yoke and an axially adjustable blockout apparatus. The yoke comprises a body portion including a pair of substantially parallel upper and lower straps having at least two tapered portions and a pair of vertical side post members interconnecting the upper and lower straps, a rear end portion spaced rearwardly of the vertical side posts in a direction of a longitudinal centerline of the yoke and connected to rearward extremities of the upper and lower straps and having a rear draft blockout seat. Forwardly extending portions of the upper and lower straps provide an upper forward portion of the yoke and a lower forward portion of the yoke, each of such upper forward portion and such lower forward portion having an apertured thickened portion and a nose extending forwardly of the apertured thickened portion. An inner surface of the nose is inclined outwardly of the longitudinal centerline of the yoke. One of the upper and lower straps in the body portion of the yoke has a slot therein; the yoke has a pocket defined by the rear draft blockout seat, the upper and the lower straps and the side post members. The axially adjustable blockout apparatus comprises an elongated adjusting mechanism for adjusting the axial length of the axially adjustable blockout apparatus, the axially adjustable blockout apparatus being adapted for mounting within the pocket of the yoke and the slot in one of the upper and lower straps being registerable with and adapted for providing access to the elongated adjusting mechanism when the axially adjustable blockout apparatus is mounted within the pocket of the yoke.

In another aspect of the invention there is provided a slackless drawbar assembly for connecting adjacent ends of a pair of railway cars together in a substantially semi-permanent manner which assembly comprises a yoke and a draft gear pocket axially adjustable blockout apparatus. The latter comprises a pair of spaced end blocks, each end block having a top wall, a bottom wall, a pair of end walls, a pair of side walls, and confronting end faces, each of the confronting end faces having a pair of inclined surfaces along at least a portion thereof converging from the top wall and the bottom wall towards an intermediate section of the end face. The axially adjustable blockout apparatus further comprises a pair of first and second spaced wedge members disposed between the spaced end blocks, each of the pair of wedge members having side walls, an outer wall and an inner wall, with the inner walls confronting each other, and end walls converging from the outer wall towards the inner wall; apparatus for slidably connecting such pair of spaced wedge members with the pair of end blocks with each of the converging end walls of the spaced wedge members contacting an inclined surface of a confronting end face of an end block.

There is a first threaded bore disposed in the first wedge member and extending therethrough between the inner and outer walls thereof; a second threaded bore disposed in the second wedge member and extending therethrough between the inner and outer walls thereof and coaxially aligned with the first threaded bore and having threads of an opposite direction to the threads of the first threaded bore. There is a threaded member extending into the first threaded bore and the second threaded bore of the spaced wedge members. Such threaded member has a head at one end, a gripping member at an opposite end, and a shank portion extending between the head and the gripping member; a first portion of the shank portion adjacent the head, having a threaded portion engageable with threads in the first threaded bore; and a second portion of the shank portion, adjacent the gripping member having a threaded portion engageable with threads in the second threaded bore, whereby, upon threading of the threaded member into the threaded bores of the spaced wedge members, such pair of confronting spaced wedge members will be secured together and upon rotating the threaded member in one direction, with the spaced wedge men%bets restrained from rotation, the pair of spaced wedge members will be moved together, while upon rotating the threaded men%her in an opposite direction the pair of spaced wedge members will be moved apart.

A still further aspect of the invention discloses a slackless drawbar assembly for connecting adjacent ends of a pair of railway cars together in a substantially semi-permanent manner which assembly comprises a yoke and a draft gear pocket axially adjustable blockout apparatus. The axially adjustable blockout apparatus comprises a pair of spaced end blocks, each of which has a top wall portion, a bottom wall portion, a pair of end wall portions, a pair of side wall portions, and confronting end faces, each confronting end face having a pair of inclined surfaces along at least a portion thereof converging towards an intermediate section of the end face from a respective top wall portion and bottom wall portion. The axially adjustable blockout apparatus includes a pair of spaced wedge shaped members disposed between the pair of spaced end blocks, each of the pair of spaced wedge shaped members having a pair of side wall portions, an outer wall portion and an inner wall portion, with each of the inner wall portions confronting each other, and a pair of end wall portions converging from the outer wall portion towards the inner wall portion. There is also a threaded member engageable with each of the pair of spaced wedge shaped members for adjustably securing the confronting pair of spaced wedge shaped members together and apparatus for slidably connecting the pair of spaced wedge shaped members with the pair of spaced end blocks, with each of the converging end wall portions of the spaced wedge shaped men%hers contacting an inclined surface of a confronting end face of a spaced end block.

Another aspect of the invention shows a slackless drawbar assembly for connecting adjacent ends of a pair of railway cars together in a substantially semi-permanent manner which assembly comprises a yoke and a draft gear pocket axially adjustable blockout apparatus, the latter being characterized by an adjustable securing device as described below.

There is a first wedge shaped member having each of a horizontally disposed top wall portion and a horizontally disposed bottom wall portion, a pair of substantially vertically disposed end wall portions and a pair of tapered side wall portions extending between the top wall portion and the bottom wall portion and between the pair of end wall portions, the top wall portion having a predetermined width which is wider than a predetermined width of the bottom wall portion. There is also a second wedge shaped member spaced from and confronting the first wedge shaped member, the second wedge shaped member having each of a horizontally disposed top wall portion and a horizontally disposed bottom wall portion, a pair of substantially vertically disposed end wall portions and a pair of tapered side wall portions extending between the top wall portion and the bottom wall portion and between the pair of end wall portions, such top wall portion having a predetermined width which is narrower than a width of the bottom wall portion. The first wedge shaped member has a first threaded bore extending between and through its top wall portion and its bottom wall portion and having threads oriented in one of a left hand and a right hand predetermined direction. The second wedge shaped member has a second threaded bore extending between and through its top wall portion and its bottom wall portion and disposed in axial alignment with the first threaded bore, such second threaded bore having threads oriented in an opposite one of a left hand and a right hand predetermined direction of the thread in the first threaded bore. The adjustable securing device also includes a threaded member extending into the first threaded bore of the first wedge shaped member and into the second threaded bore of the second wedge shaped member- Such threaded men%her comprises a head portion disposed at a first end thereof, a gripping member portion disposed at an axially opposed second end thereof, and a shank portion extending between the head portion and the gripping member portion, a first portion of the shank portion located adjacent such head portion, having a threaded portion engageable with the threads disposed in the first threaded bore in the first wedge shaped member and a second portion of the shank portion, located adjacent the gripping member portion, having a threaded portion engageable with the threads disposed in the second threaded bore in the second wedge shaped member so that upon threading of the threaded member into the first threaded bore in the first wedge shaped member and the second threaded bore in the second wedge shaped member, the first wedge shaped member and the second wedge shaped member will be secured together and upon rotating the threaded member in a first direction with the first wedge shaped member and the second wedge shaped member being restrained from rotation they will be moved toward one another and upon rotation of the threaded member in an opposite direction they will be moved apart.

In yet another aspect of the invention there is disclosed a slackless drawbar assembly for connecting adjacent ends of a pair of railway cars together in a substantially semi-permanent manner which assembly comprises a yoke and a draft gear pocket axially adjustable blockout apparatus, the latter being characterized by an adjustable securing device comprising a first wedge shaped member having each of a horizontally disposed top wall portion, a horizontally disposed bottom wall portion, a pair of substantially vertically disposed end wall portions in which vertically oriented outer edges thereof converge towards each other from the top wall portion to the bottom wall portion and a pair of tapered side wall portions extending between the top wall portion and the bottom wall portion and between such pair of end wall portions, and a second wedge shaped member spaced from and confronting the first wedge shaped member. The second wedge shaped member has each of a horizontally disposed top wall portion and a horizontally disposed bottom wall portion, a pair of substantially vertically disposed end wall portions in which vertically oriented outer edges thereof converge towards each other from the bottom wall portion to the top wall portion and a pair of tapered side wall portions extending between the top wall portion and the bottom wall portion and between the pair of end wall portions. There is a first threaded bore extending between and through the top wall portion and the bottom wall portion of the first wedge shaped men, her and having threads oriented in one of a left hand and a right hand predetermined direction, a second threaded bore extending between and through the top wall portion and the bottom wall portion of the second wedge shaped member, and disposed in axial alignment with the first threaded bore, such second threaded bore having threads oriented in an opposite one of a left hand and right hand predetermined direction of the threads in the first bore; and a threaded member extending into the first threaded bore of the first wedge shaped member and into the second threaded bore of the second wedge shaped member. The threaded member includes a head portion disposed at a first end thereof, a gripping member portion disposed at an axially opposed second end thereof, and a shank portion extending between the head portion and the gripping member portion. A first portion of such shank portion, located adjacent the head portion, has a threaded portion engageable with the threads disposed in the first threaded bore in the first wedge shaped member and a second portion of such shank portion, located adjacent the gripping member portion, has a threaded portion engageable with the threads disposed in the second threaded bore in the second wedge shaped member so that upon threading of the threaded member into the first threaded bore in the first wedge shaped member and into the second threaded bore in the second wedge shaped member, the first wedge shaped member and the second wedge shaped member will be secured together and upon rotating the threaded member in a first direction with the first wedge shaped member and the second wedge shaped member being restrained from rotation they will be moved toward one another and upon rotation of the threaded member in an opposite direction they will be moved apart.

OBJECTS OF THE INVENTION

It is one of the objects of this invention to provide an improved slackless drawbar system which can readily be used to retrofit existing railway cars already having a drawbar system or to replace a conventional AAR coupler and draft gear or can be applied to new railway cars having a center sill.

Another object of this invention is to provide a slackless drawbar system employing an improved yoke which can be produced as a one piece, integral casting.

Another object of this invention is to provide a slackless drawbar system employing an improved adjustable blockout apparatus which will minimize wear on the components of a slackless drawbar coupling arrangement.

A further object of this invention is to provide a slackless drawbar system which can withstand applied forces of up to one million pounds.

Still another object of this invention is to provide a slackless drawbar system employing an easily adjustable blockout device.

Yet another object of this invention is to provide a slackless drawbar system employing a yoke which can be easily removed for maintenance on the yoke or another component of the drawbar system.

It is also an object of this invention to provide a slackless drawbar system whose components will be subject to reduced wear.

These and various other additional objects and advantages of the invention will become apparent to persons skilled in the art from the following description of the invention particularly when reviewed in conjunction with the appended drawings and claims.

DESCRIPTION OF THE INVENTION

Figure 1:
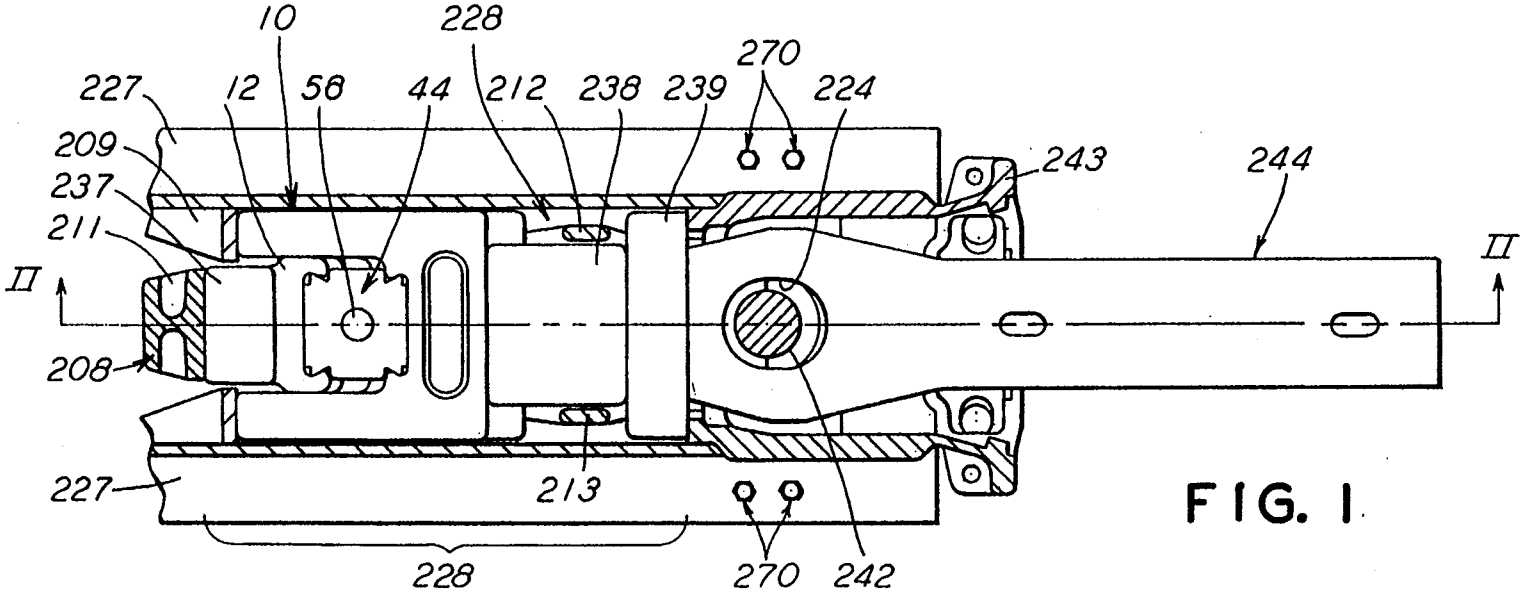
FIG. 1 is a cross-sectional view taken along the line I—I in FIG. 2 of one end of a slackless drawbar arrangement of the invention in position with respect to a center sill of a railway car.

Prior to proceeding to a more detailed description of the various preferred and alternative embodiments of the present invention it should be noted that, for the sake of clarity, identical components which have identical functions have been identified with identical reference numerals throughout the several views illustrated in the drawings.

Referring now to FIGS. 6 through 17 of the drawings, a draft gear pocket axially adjustable blockout apparatus, generally designated 10, is illustrated. The axially adjustable blockout apparatus 10 includes a pair of spaced end blocks 12 and 14. Each of the spaced end blocks 12 and 14 has a top wall portion 16, a bottom wall portion 18, an end wall portion 20, a pair of side wall portions 22 and confronting end face portions 24. The spaced end blocks 12 and 14 are preferably steel castings meeting AAR Specification M-211, Grade "E". At least one of the end wall portions 20 of the spaced end blocks 12 and 14 preferably has an angular surface as indicated at 26 forming an acute angle with the bottom wall portion 18. Each of the confronting end faces 24 of the pair of spaced end blocks 12 and 14 has a first inclined surface 28 along at least a portion of the end face 24 converging towards a confronting inclined surface 28 of the confronting end face 24, from the top wall portion 16 towards an intermediate section 30 of the end face 24, and a second inclined surface 32 along at least a portion of the end face 24 converging towards a confronting inclined surface 32 of the confronting end face 24, from the bottom wall portion 18 towards the intermediate section 30 of the end face 24.

In a presently preferred embodiment of the axially adjustable blockout apparatus 10, flanges 34 and 36 are provided on each of the inclined surfaces 28 and 32 of the end faces 24 of spaced end blocks 12 and 14, which flanges 34 and 36 are adjacent the side wall portions 22 and extend outwardly from the confronting end faces 24 toward each other, with the outer surfaces 38 and 40 of the flanges 34 and 36, respectively, being parallel to the inclined surfaces 28 and 32, respectively, of the end faces 24. The intermediate section 30 of the blocks 12 and 14 may have an arcuate groove 42 formed therein to provide clearance for a threaded member to be presently described.

Figure 21:
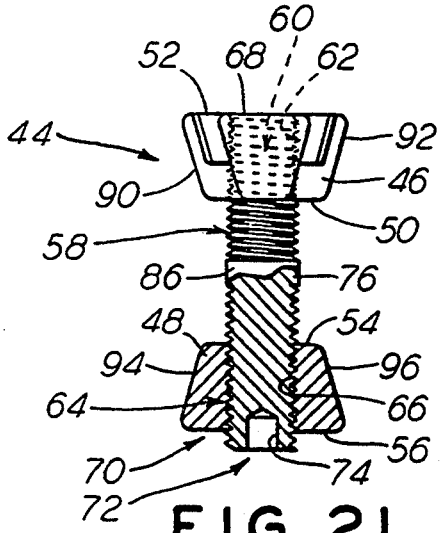
FIG. 21 is a partial cross-sectional view taken along the lines XXI—XXI of FIG. 18.
Figure 22:
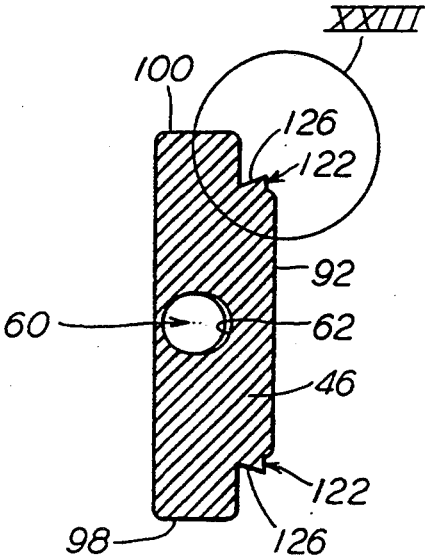
FIG. 22 is a cross-sectional view taken along the lines XXII—XXII of FIG. 20.

An axially adjustable securing device, FIG. 21, generally designated 44, is provided for adjustably securing the pair of confronting spaced end blocks 12 and 14 together. Referring now to FIGS. 18 through 27, a presently preferred adjustable securing device 44 comprises a first wedge shaped member 46 and spaced second wedge shaped member 48. The first wedge shaped member 46 has an inner wall portion 50 and an outer wall portion 52, while the second wedge shaped member 48 has an inner wall portion 54 and an outer wall portion 56 with the spaced wedge shaped members 46 and 48 secured together in confronting relationship by use of a threaded member 58, with the inner wall portions 50 and 54 spaced from and confronting each other.

Figure 6:
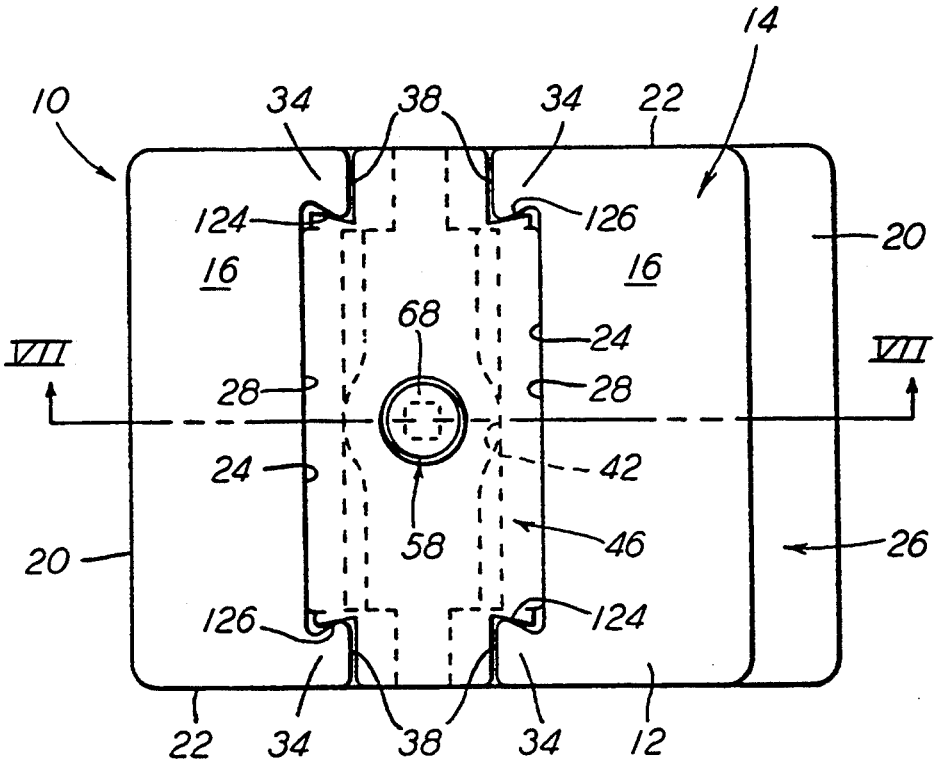
FIG. 6 is a top plan view of a preferred form of blockout apparatus used in the invention.
Figure 7:
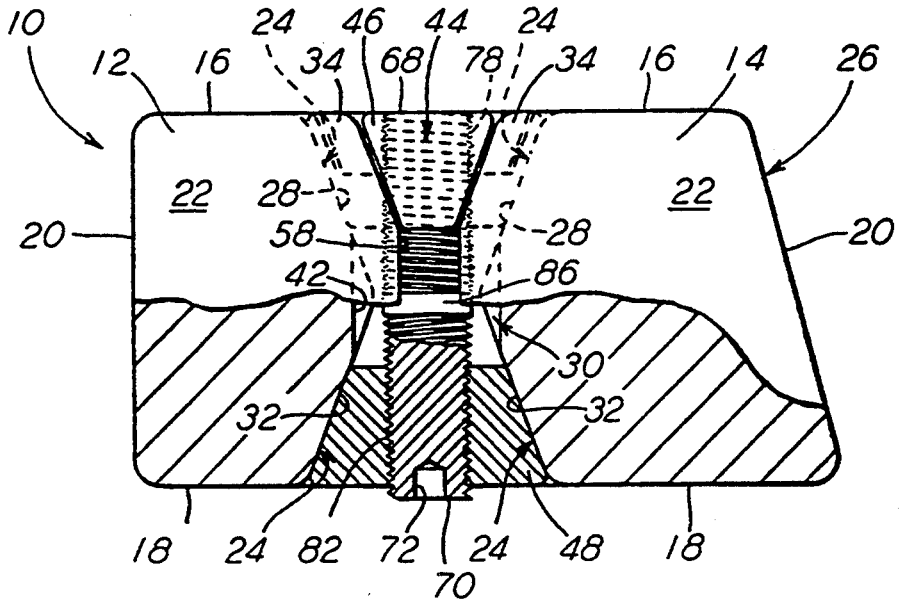
FIG. 7 is a side elevational view of the apparatus shown in FIG. 6 with the lower portion shown in cross-section.
Figure 8:
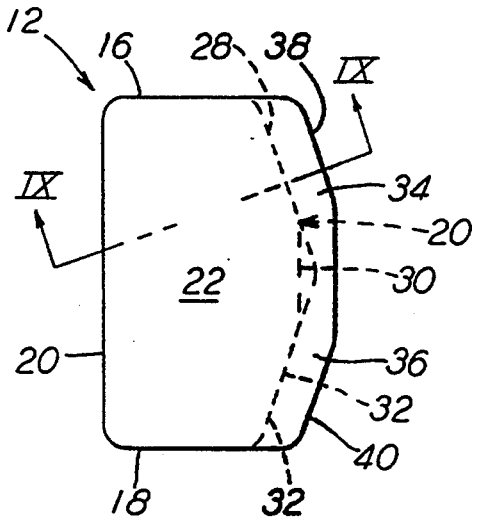
FIG. 8 is a side elevational view of one of the spaced end blocks.
Figure 10:
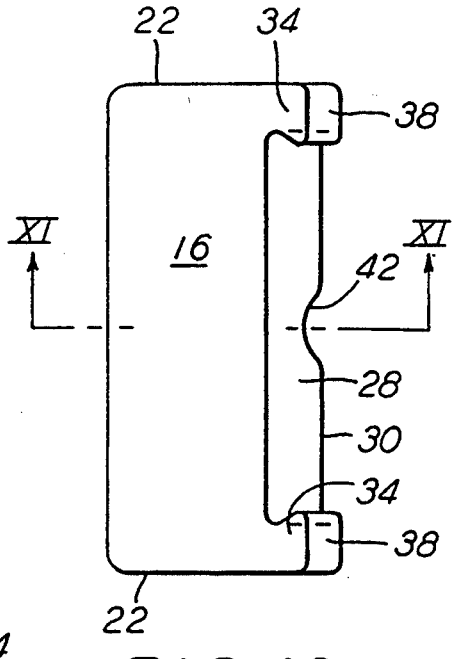
FIG. 10 is a top plan view of the end block illustrated in FIG. 8.
Figure 11:
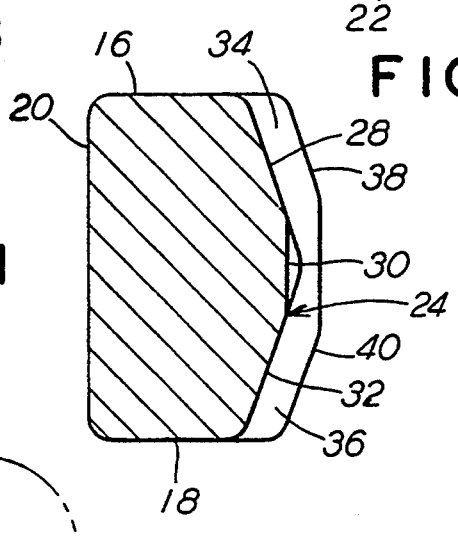
FIG. 11 is a cross-sectional view taken along lines XI—XI of FIG. 10.
Figure 9:
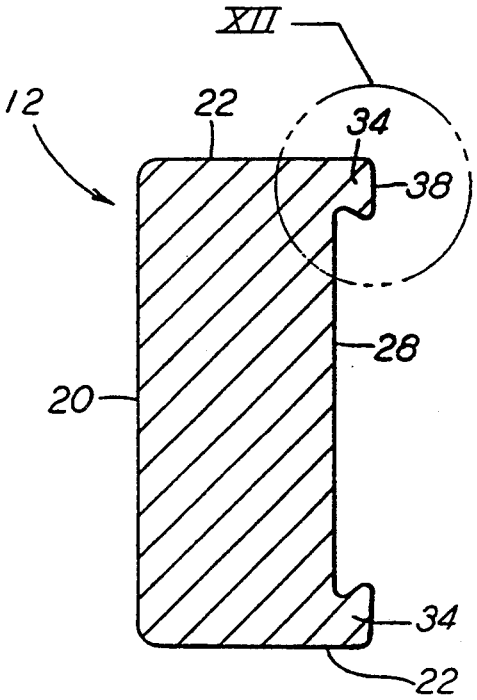
FIG. 9 is a cross-sectional view taken along lines IX—IX of FIG. 8.

As can be seen in FIG. 6, each of the flanges 34 has an undercut portion defined by angular face 124 which, as described later, cooperates with a complementary tongue or dovetail tenon having an angular face 126 that is provided on wedge shaped member 46 to adjustably secure the spaced end blocks 12 and 14 to the wedge shaped member. The undercut portion of the flange together with the end faces 28 form a dovetail mortise to slidably receive a complementary portion of the wedge shaped member to form an adjustable dovetail mortise and tenon slidably retaining the spaced end blocks 12 and 14. In like manner, flanges 36 have undercut portions which taken with end faces 32 of the end blocks form a dovetail mortise which engages a dovetail tenon formed by tongues or tenons on the wedge shaped member 48.

Figure 25:
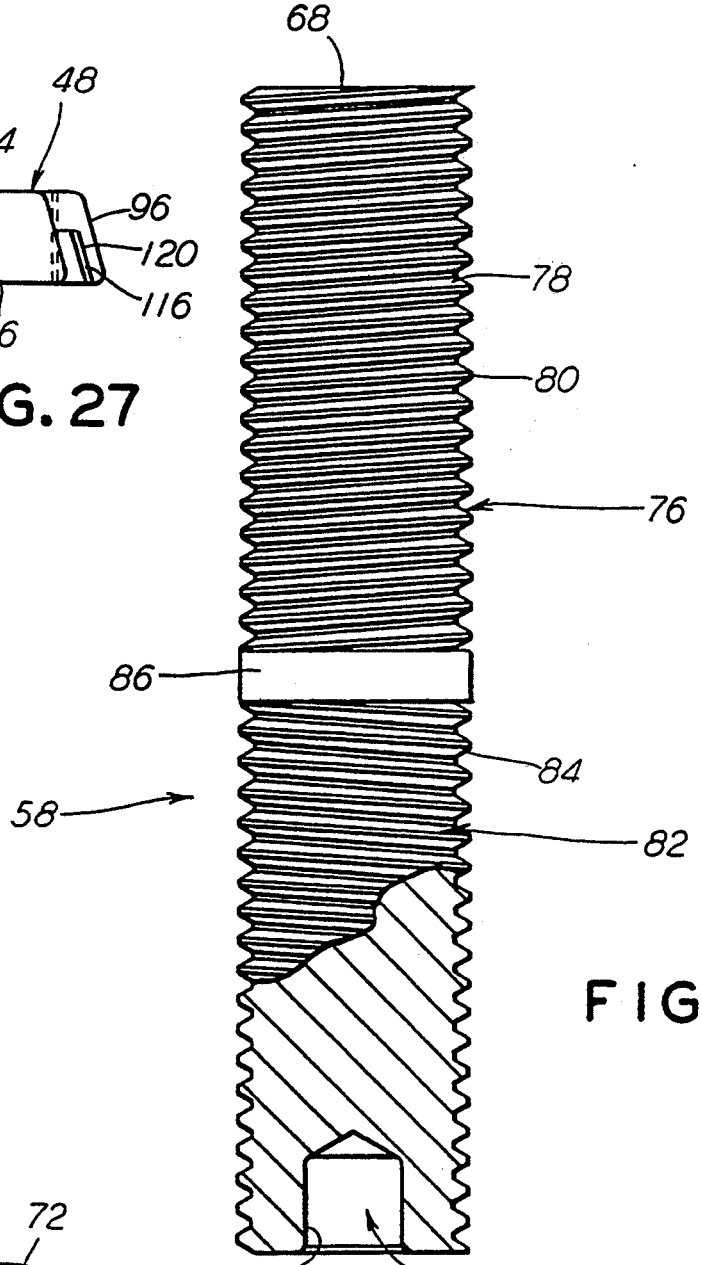
FIG. 25 is an elevational view, partly in section, illustrating a threaded member usable in the adjustable securing device of the adjustable blockout apparatus of the present invention.
Figure 26:
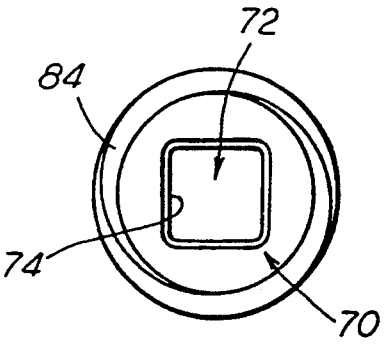
FIG. 26 is an end view of the threaded member of FIG. 25 illustrating a gripping member for permitting rotation of the threaded member.
Figure 24:
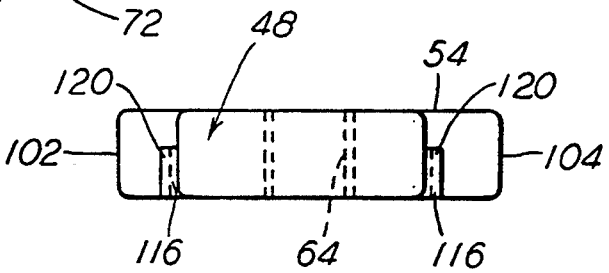
FIG. 24 is a side elevational view similar to FIG. 20 of the other of the spaced wedge members comprising the adjustable securing device.

A first threaded bore 60 is formed through the first wedge shaped member 46, which bore extends between and through the inner and outer wall portions 50 and 52, and has threads 62 which are formed in one predetermined direction, either left or right handed threads. A second threaded bore 64 is formed through the second wedge shaped member 48, which second threaded bore extends between and through the inner and outer wall portions 54 and 56, and has threads 66 which are formed in the opposite direction of the threads 62 of the first threaded bore 60, either right or left handed threads. The threaded member 58, FIGS. 25 and 26, has a head portion 68 at one end and a gripping member portion 70 at the other end thereof. The gripping member 70 is illustrated in FIGS. 25 and 26 as a recess 72 having a polygonal side wall 74. A shank portion 76 extends between the head portion 68 and the gripping member portion 70 of the threaded member 58, which shank portion 76 has a first threaded portion 78, adjacent the head portion 68, having threads 80 which are engageable with the threads 62 of the first threaded bore 60 of the first wedge shaped member 46, and a second threaded portion 82, adjacent the gripping member portion 70, having threads 84 which are engageable with the threads 66 of the second threaded bore 64 of the second wedge shaped member 48. Between the first threaded portion 78 and the second threaded portion 82 of the threaded member 58 there is provided an unthreaded portion 86 in a presently preferred embodiment of the invention.

The first wedge shaped member 46 has a pair of end wall portions 90 and 92, at least one of which converges towards the other from such outer wall portion 52 to such inner wall portion 50, with preferably both of the end wall portions 90 and 92 so converging. Second wedge shaped member 48 also has a pair of end wall portions 94 and 96, at least one of which converges towards the other from such outer wall portion 56 to such inner wall portion 54, with preferably both of the end wall portions 94 and 96 so converging, as shown in FIG. 21. The wedge shaped members 46 and 48 also have side wall portions 98, 100, 102 and 104 respectively.

Figure 23:
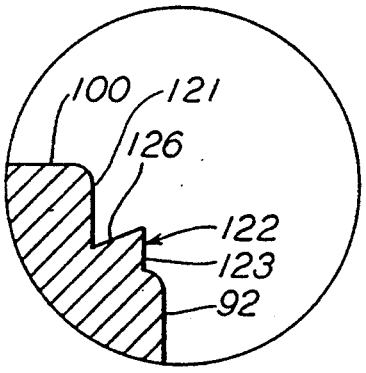
FIG. 23 is an enlarged view of the area in the circle XXIII in FIG. 22 showing a presently preferred dove tail engagement on a wedge member.
Figure 27:
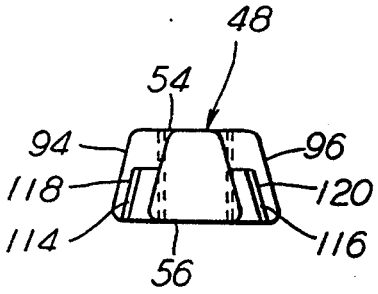
FIG. 27 is an end view of the spaced wedge member shown in FIG. 24.

On the first wedge shaped member 46, each end wall portion 90 and 92 has an outwardly extending first tongue 106 and 108, respectively, each of which has an outer surface 110 and 112, respectively, that is complementary with the inclined surface 28 of the confronting end faces 24 of spaced end blocks 12 and 14, while on the second wedge shaped member 48, each end wall portion 94 and 96 has an outwardly extending second tongue 114 and 116, respectively, each of which has an outer surface 118 and 120, respectively, that is complimentary with the inclined surface 32 of the confronting end faces 24 of the spaced end blocks 12 and 14. The edges of tongues 106, 108, 114, and 116 preferably are recessed from the side walls, and a key member 122 extends outwardly from each of the edges with the key members designed to be slidably engaged with the flanges 34 and 36 provided on the spaced end blocks 12 and 14 and to interlock the wedge shaped members 46 and 48 with the end blocks 12 and 14. As seen in the drawings, key members 122 may extend less than the full depth of tongues 106, 108, 114 and 116. As shown in FIG. 6, flanges 34 and 36 on the spaced end blocks 12 and 14 have an angular face 124 designed to be engaged with a complementary angular surface 126 provided on the key member to provide sliding engagement between angular faces 124 of the flanges 34 and 36 and angular surfaces 126 of the key members 122. The end wall portions 90, 92, 94 and 96 of the wedge shaped members together with their respective adjacent tongues 122 comprise a dovetail tenon which fits in the dovetail mortise, previously described, formed by the end faces 28 and 32 respectively of the spaced end blocks and the undercut portions of the flanges 34 and 36. The end wall portions 90 and 92 of the wedge shaped member 46 and the end wall portions 94 and 96 of the wedge shaped member 48 are shorter than the distance from side wall portions 98 and 102 respectively to side wall portions 100 and 104 respectively so that wedge shaped members 46 and 48 can nest between the flanges 34 and 36 of the spaced end blocks 12 and 14 with the surfaces of end walls 90 and 92 and 102 and 104 respectively in proximate and complementary contact with the inclined faces 28 and 32 respectively of the spaced end blocks. The end wall portions 90, 92, 94 and 96 are undercut at each of their ends as shown at 126 in FIG. 6 to form a key member 122 so that key members 122 with their adjoining end wall portions 90, 92, 94 and 96 form a dovetail tenon on each end wall portion of wedge shaped members 46 and 48 which will interlock with and slidably engage the dovetail mortises formed by surfaces 28 and 32 of spaced end blocks 12 and 14 and the angular faces 124 on flanges 34 and 36 respectively. In this manner, the mortises and tenons serve to adjustably connect the spaced end blocks to the wedge shaped members. The spaced end blocks will be moved toward and away from each other as the wedge shaped members are moved away or toward each other by rotation of the threaded member 58. As best seen in FIG. 23, the surface 123 of each key member 122 may be recessed from the surface of its adjoining end wall portion 90, 92, 94 and 96. With this construction, key members 122 will not bear any of the service load applied to the blockout device, such loads being transmitted from spaced end blocks 12 and 14 by contact between surfaces 28 and 32 respectively of the spaced end blocks with the surfaces of end wall portions 90 and 92 of wedge shaped men%her 46 and end wall portions 94 and 96 of wedge shaped member 48.

Figure 12:
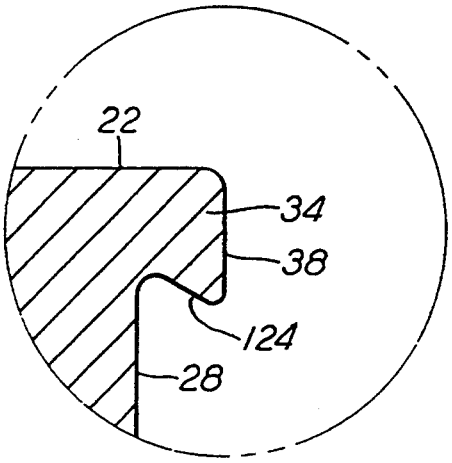
FIG. 12 is an enlarged view of the area of the flange portion of the end block illustrated in Circle XII of FIG. 9.
Figure 13:
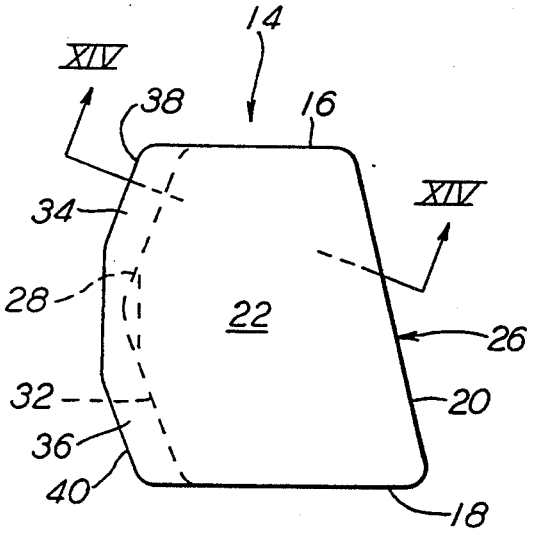
FIG. 13 is a side elevational view of the other of the pair of spaced end blocks.
Figure 15:
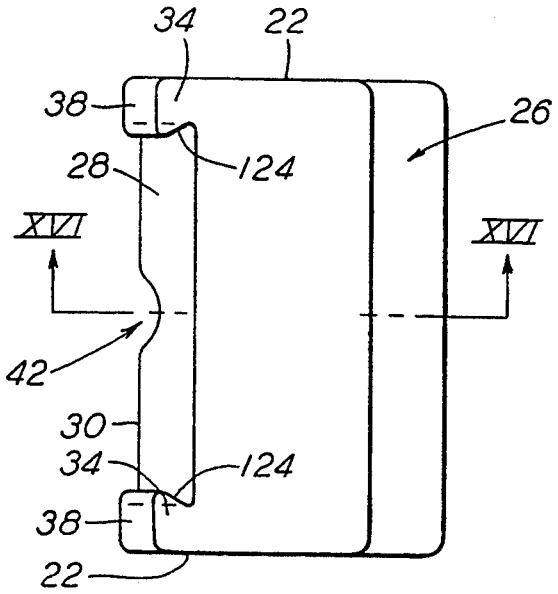
FIG. 15 is a top plan view of the end block illustrated in FIG. 13.
Figure 16:
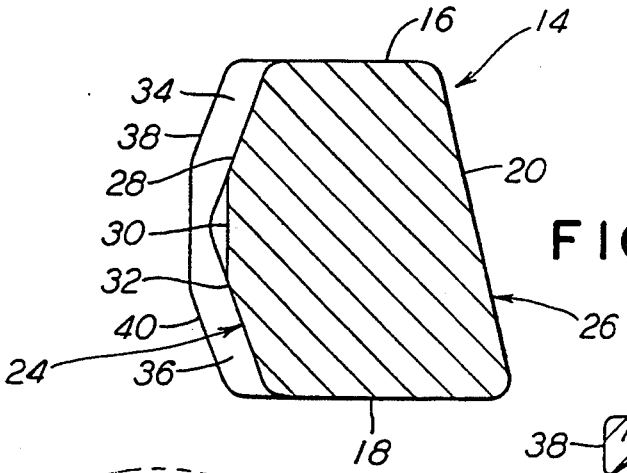
FIG. 16 is a cross-sectional view taken along line XVI—XVI of FIG. 15.
Figure 17:
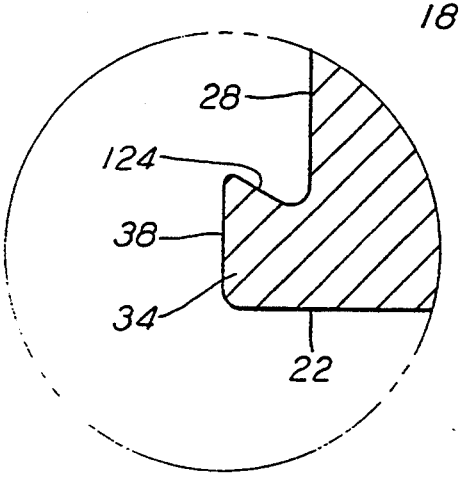
FIG. 17 is an enlarged view of the area of the flange portion of the end block within the Circle XVII of FIG. 14.
Figure 14:
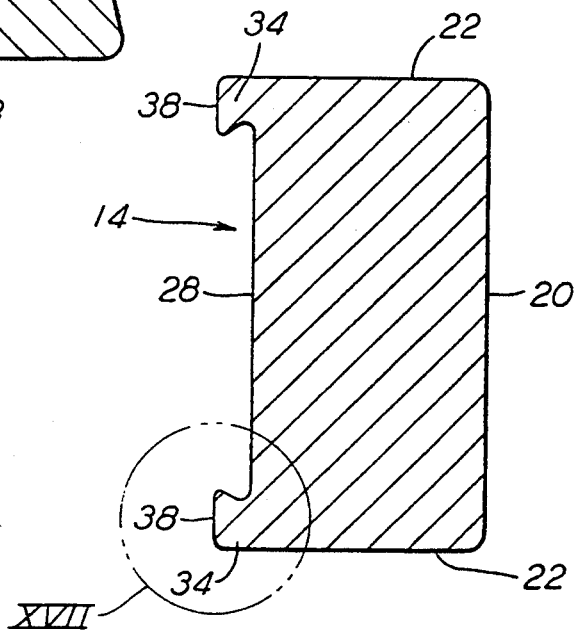
FIG. 14 is a cross-sectional view taken along lines XIV—XIV of FIG. 13.
Figure 18:
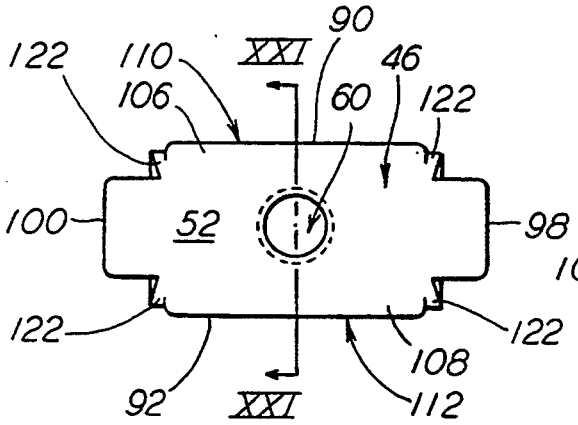
FIG. 18 is a top plan view of one of a pair of spaced wedge members adjustably securable together in the adjustable blockout apparatus of a presently preferred embodiment of the present invention.
Figure 19:
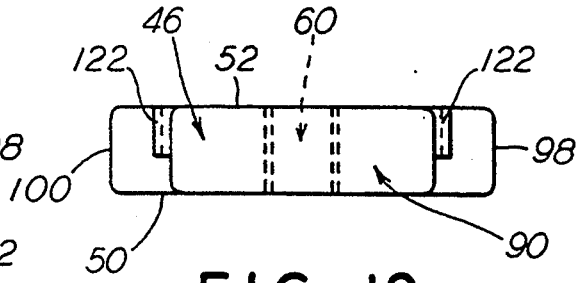
FIG. 19 is a side elevational view of a spaced wedge member of FIG. 18.
Figure 20:
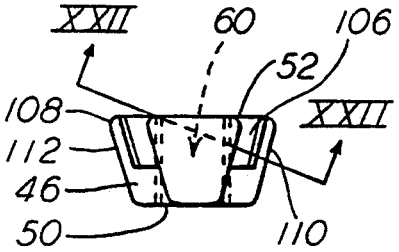
FIG. 20 is an end view of a spaced wedge member of FIG. 18.

In addition to recessing the surfaces of the key members 122 as described above, the inside and outside corners of the interlocking key members and flanges may be rounded as best seen in FIGS. 12, 17 and 23. This construction helps to avoid sticking and binding as the dovetail members are moved relative to each other during adjustment of the blockout apparatus.

Figure 28:
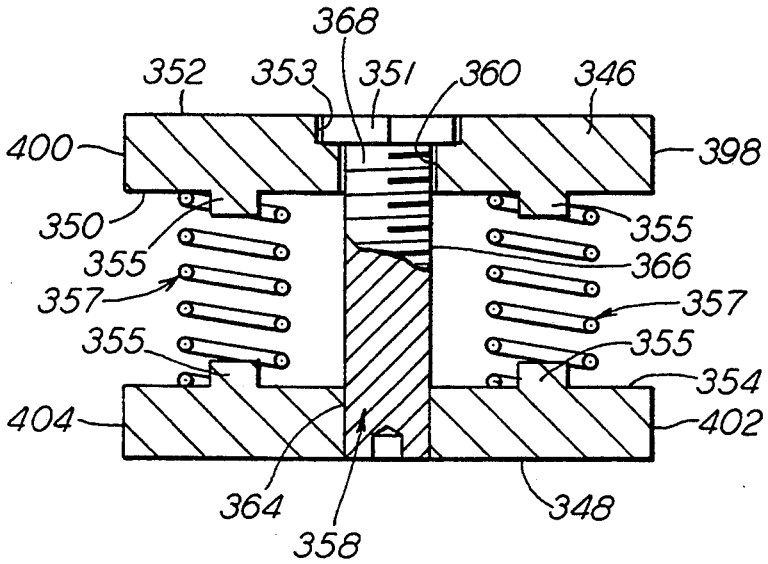
FIG. 28 is a cross-sectional view taken along lines XXVIII—XXVIII of FIG. 29 of an adjustable securing device used in an alternative form of the invention.
Figure 29:
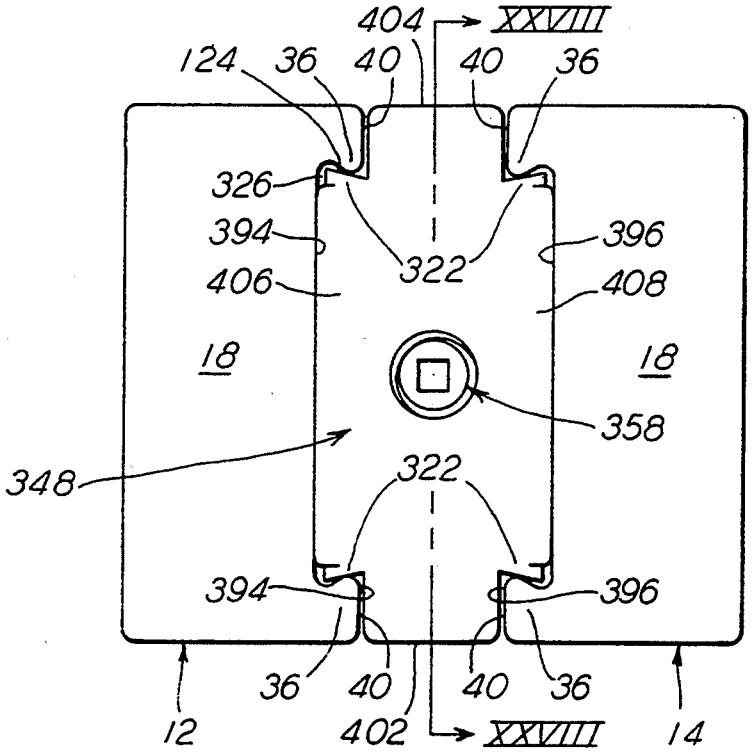
FIG. 29 is a bottom plan view of an adjustable blockout apparatus using the form of adjustable securing device shown in FIG. 28.

In an alternative form of adjustable securing device, seen in FIGS. 28 and 29, a threaded member 358 may be provided which has threads 366 in one direction only, left or right hand, which engage a threaded bore 364 in a wedge shaped member 348. A second wedge shaped member 346 is provided in confronting relationship with wedge shaped member 348 and wedge shaped member 346 is provided with a bore 360 in substantial alignment with threaded bore 364. The bore 360 in wedge shaped member 346 is larger than the major diameter of threads 366 so that threaded member 358 can slide through bore 360. A bolt head or other retaining means 351 is secured to the head portion 168 of threaded member 358 to hold wedge shaped member 346 secured to wedge shaped member 348. An enlarged counterbore 353 is provided so that retaining means 350 is normally recessed below the outer wall portion 352 of wedge shaped member 346. Springs 357 and spring retainer posts 355 are also provided. Spring retainer posts 355 are formed integrally with wedge shaped members 346 and 348 or may be otherwise secured thereto, at least one spring retainer post being provided on each of members 346 and 348 and preferably two such posts being provided on each of such members. The spring retainer posts are provided on the confronting faces 350, 354 of wedge shaped men, pets 346 and 348 respectively. Preferably the bores 360 and 364 are centered on a longitudinal centerline extending between sidewalls 398 and 400 of wedge shaped member 346 and on a longitudinal centerline extending between sidewalls 402 and 404 of wedge shaped member 348 and are located approximately midway between such sidewalls 398 and 400 and 402 and 404. At least one of the spring retainer posts is located on wedge shaped member 346 and at least one of such posts is located on wedge shaped member 348 with two such posts preferably secured to each of such wedge shaped members and preferably one spring retainer post being located on each side of the bores 360 and 364 between such bores and the sidewalls 398 and 400 and between such bores and the sidewalls 402 and 404. Preferably the posts 355 are also centered on the longitudinal centerline on which the bores 360 and 364 are centered and preferably the posts 355 on wedge shaped member 346 are located in opposed relation to the posts 355 on wedge shaped member 348 and in alignment therewith. Springs 357 are compression springs which fit closely over the spring retainer posts to normally urge wedge shaped members 346 and 348 apart to the extent permitted and determined by the position of threaded member 358 within the threaded bore 364. Spring retainer posts 355 serve to hold springs 357 in substantially axially aligned position.

Except as is apparent from the above description the wedge shaped members 346 and 348 are substantially identical to wedge shaped members 46 and 48 previously described and the sets of wedge shaped members 46 and 48 and 346 and 348 respectively can be used as direct replacements for each other with a given set of end blocks 12 and 14. FIG. 29 shows wedge shaped member 348 assembled with a pair of end blocks 12 and 14. Wedge shaped members 346 and 348 have side wall portions 398 and 400 and 402 and 404 respectively. As seen in FIG. 29, wedge shaped member 348 has end wall portions 394 and 396 which have outwardly extending tongues 406 and 408 respectively that terminate in key members 322 at each of their ends. The key members have angular surfaces 326 that mate with angular surfaces 124 on the flanges 34 and 36 to provide a sliding interlocking connection similar to a mortise and tenon between the wedge shaped members 346 and 348 and the spaced end blocks 12 and 14.

Now reference is made, more particularly, to FIGS. 1 through 5. Illustrated therein is a presently preferred embodiment of the slackless drawbar assembly of this invention including a yoke, generally designated 205, and adjustable blockout apparatus generally designated 10.

The yoke 205 includes a rear end portion 208 which has a front face 209. The front face 209 forms a rear seat or bearing surface for a blockout device, generally designated 10, previously described. According to the presently preferred embodiment of the invention, the rear end portion 208 will include at least one cavity 211 and preferably four cavities 211 for reducing the weight of the yoke 205. Such cavities 211 being formed in the vertical side portions of the rear end portion 208.

Figure 4:
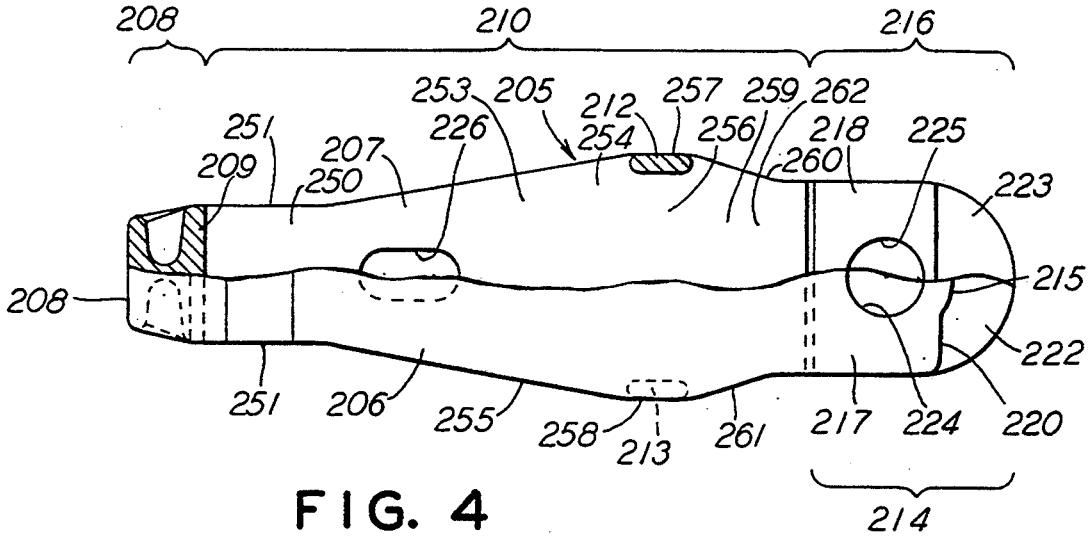
FIG. 4 is a top plan view, partly in cross-section, of the yoke shown in FIG. 3.
Figure 5:
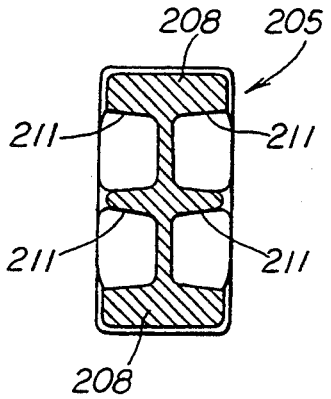
FIG. 5 is a cross-sectional view of the pocket end of the yoke taken along the line V—V in FIG. 3.

Yoke 205 further includes a body portion, generally designated 210. The body portion 210 includes a top strap portion 206 which is connected at a first end thereof to a first end of such rear end portion 208. This top strap portion 206 extends forwardly of the front face 209 of such rear end portion 208 for a first predetermined length. The top strap portion 206 has a predetermined thickness. In addition, the body portion 210 of the yoke 205 includes a bottom strap portion 207. A first end of the bottom strap portion 207 is connected to a radially opposed second end of such rear end portion 208. This bottom strap 207 extends forwardly of the front face 209 of the rear end portion 208 of such yoke 205 for a second predetermined length. Such bottom strap portion 207 also has a predetermined thickness. According to the presently preferred embodiment of the invention the first predetermined length of the top strap portion 206 will be substantially identical to the second predetermined length of such bottom strap portion 207. It is also preferred that the thickness of the top strap portion 206 and of the bottom strap portion 207 will be substantially identical. In addition, each of the top strap portion 206 and the bottom strap portion 207 have a predetermined configuration as best seen in FIG. 4.

A top forward portion, generally designated 214, of the yoke 205 has a first end thereof connected to a radially opposed second end of such top strap portion 206. This top forward portion 214 includes a portion 217 thereof which is thicker than the predetermined thickness of such top strap portion 206.

Similarly, a bottom forward portion, generally designated 216, of the yoke 205 has a first end thereof connected to a radially opposed second end of such bottom strap portion 207. The bottom forward portion 216 also includes a portion 218 thereof which is thicker than the predetermined thickness of such bottom strap portion 207. The thickened portions 217 and 218 have first and second generally round apertures 224 and 225 respectively formed therein. The top forward portion 214 and the bottom forward portion 216 of the yoke 205 terminate in an upper nose portion 219 and a lower nose portion 221 respectively of reduced thickness formed by a step 220 extending from the outer surfaces of the thickened portions 217 and 218 to substantially horizontally extending outer surfaces of the respective nose portions 219 and 221. As best seen in FIG. 4, the step 220 comprises an arcuate portion 215 extending the thickened portion of this part of the yoke 205 around and away from apertures 224 and 225 thus providing extra strength in this area to resist the forces exerted on the yoke 205 through means connecting the yoke 205 with a drawbar 244. Spaced from and extending forwardly of apertures 224 and 225 are inclined inner surfaces, denoted respectively by numerals 222 and 223, of the respective nose portions 219 and 221. The inner surfaces 222 and 223 are inclined outwardly of the longitudinal centerline of the yoke 205 at an angle thereto to accommodate entry of the end of a connecting drawbar 244 into the forward portion of the yoke 205 and to permit angling of such drawbar as the railway car to which it is attached traverses uneven or inclined track.

Each nose portion 219 and 221, has an outer surface disposed substantially parallel to a longitudinal centerline of the yoke 205 and an inner surface 222 and 223, respectively, inclined outwardly of such longitudinal centerline. In the presently preferred embodiment of the invention the thickened portion 217 of the top forward portion 214 will have a thickness substantially identical to the thickness of the thickened portion 218 of the bottom forward portion 216. Further, it is presently preferred that the forwardmost extremity of each nose portion 219 and 221, respectively, of each of the top forward portion 214 and the bottom forward portion 216 will have generally arcuate configuration which is preferably semicircular.

The first generally round aperture 224 has a predetermined diameter. Received in such first generally round aperture 224 is a first portion of a drawbar connecting pin member 242. Such drawbar connecting pin member 242 is illustrated in FIGS. 1 and 2.

The second generally round aperture 225 has a predetermined diameter which is preferably substantially identical to the predetermined diameter of the first generally round aperture 224. Received within the second generally round aperture 225 is a second radially opposed portion of such drawbar connecting pin 242. The yoke 205 further includes a first side post men%her 212. A first end of the first side post member 212 is connected to an inner surface of such top strap portion 206 adjacent a first outermost edge thereof and intermediate the first and second end of such top strap portion 206. The second radially opposed end of the first side post member 212 is connected to an inner surface of the bottom strap portion 207 adjacent a first outermost edge thereof and intermediate the first and second end of such bottom strap portion 207. Positioned radially opposite the first side post member 212 is a second side post member 213. Such second side post member 213 is connected at a first end thereof to the inner surface of the top strap portion 206 adjacent a second outermost edge thereof. The second radially opposed end of the second side post member 213 is connected to the inner surface of such bottom strap portion 207 adjacent a second outermost edge thereof, Lastly, an aperture 226 is formed through at least one of the top strap portion 206 and the bottom strap portion 207. In the presently preferred embodiment, the aperture 226 will be formed as an elongated slot in the bottom strap portion 207 of the yoke 205. The aperture 226 is for providing access to an adjusting means, such as the threaded member 58, used to adjust a length of the axially adjustable blockout device, generally designated 10. The adjustable blockout device is mounted within a yoke pocket defined by the front face 209 of the rear end portion 208, the inner surface of the top strap portion 206, the inner surface of the bottom strap portion 207, the inner surface of the first side post member 212 and the inner surface of the second side post member 213. According to the presently preferred embodiment of this invention, the rear end portion 208 of the yoke 205 has an arcuately shaped surface disposed radially opposite such front face 209. Further, it is preferred that the rear end portion 208, the top strap portion 206, the bottom strap portion 207, the top forward portion 214, the bottom forward portion 216, the first side post member 212 and the second side post member 213 are formed as a single piece casting. Such single piece casting is preferably a steel casting. Additionally, if desired, the weight reducing cavities 211, the aperture 226 and the apertures 224 and 225 can be simultaneously cast with the yoke 205. Further, in the presently preferred embodiment of the invention the outer surface of the nose portion 219 and 221 of the top forward portion 214 and the bottom forward portion 216, respectively, of the yoke 205 will be disposed in a plane which lies substantially parallel to the longitudinal centerline of such yoke 205. Finally, as seen in FIG. 2, each of the top strap portion 206 and the bottom strap portion 207 will preferably have a predetermined configuration which will include at least two tapered portions disposed in a horizontal plane of the yoke 205.

Figure 2:
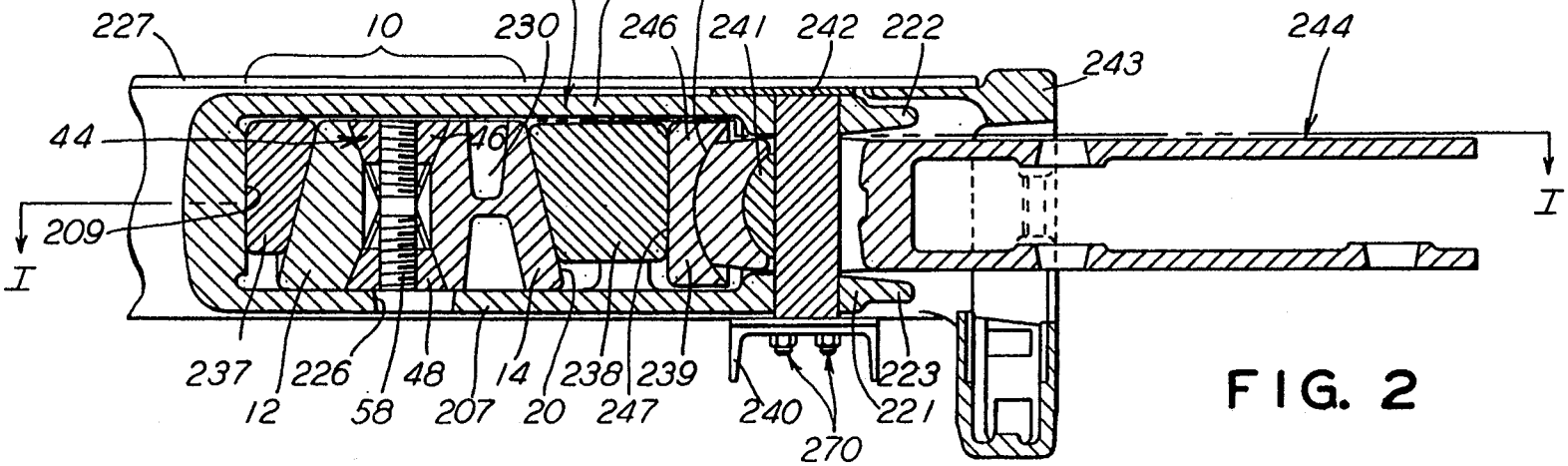
FIG. 2 is a cross-sectional view of the apparatus shown in FIG. 1 taken along the line II—II in FIG. 1.
Figure 3:
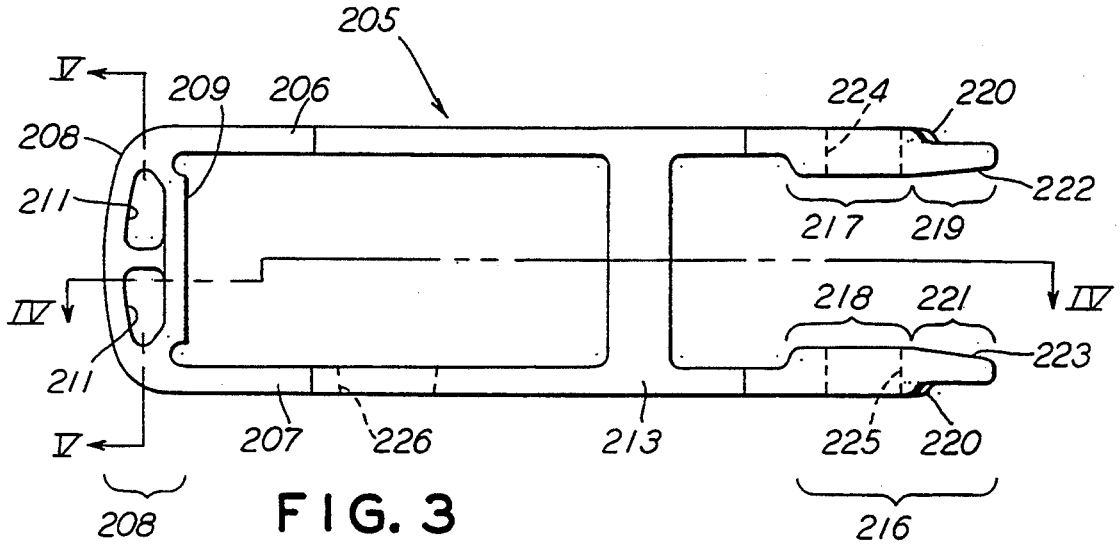
FIG. 3 is a side elevational view of a preferred form of yoke used in the invention.

The manner of mounting the yoke 205 within a center sill member 227 of a railroad car, and the general structure and manner of mounting an axially adjustable block-out device within the yoke pocket and of connecting the yoke 205 to drawbar 244 is illustrated in FIGS. 1 and 2. A striker element 243 is connected to the center sill member 227 by means of mounting member 240 which is removably secured to the center sill member for example by bolts and nuts 270. The yoke 205, the nose portions 219 and 221 of which are designed to fit within and extend into the striker element 243, is connected to a drawbar shank by means of a drawbar connecting pin 242 extending through the apertures 224 and 225 in the thickened portions 217 and 218 of the top and bottom forward portions 214 and 216 of the yoke 205. A drawbar connecting pin bearing block 241 is provided between the pin 242 and the inside of an extremity 246 of the shank of the drawbar 244.

An adjustable blockout apparatus indicated generally by the numeral 10 and as previously described above is retained in the yoke pocket 228. Such adjustable blockout apparatus includes an axially adjustable securing device 44 adjustable by means of threaded member 58 and comprises a first wedge shaped member 46 and a second wedge shaped member 49. The adjustable blockout apparatus further includes a pair of end blocks 12 and 14 adjustable by rotation of the threaded member 58, all as previously described. As shown in FIG. 2, the end block 14 may have a weight reducing cavity 230. Additional weight reducing cavities may be provided in end block 14 and also in end block 12. The outer end 232 of the extremity 246 of the drawbar is in contact with the inner face 245 of a follower 239. A filler block 238 is provided between the outer face 247 of follower 239 and the end wall 20 of end block 14. A take-up block 237 is provided between end block 12 of axially adjustable blockout apparatus 10 and the inner face 209 of the rear end portion 208 of the yoke 205. At least one end surface of filler block 238 may be disposed at an angle in a vertical direction to take up slack between the follower 239 and the end block 14 by gravity. One or both of the vertical faces of take-up block 237 may be disposed at an angle for the same purpose. Aperture 226 is shown in the bottom strap 207 of the yoke to provide access to threaded member 58 for adjustment of a length of the adjustable blockout apparatus 10.

It can best be seen from the above description that, in summary, the present invention provides a yoke and adjustable blockout apparatus for use with a slackless drawbar coupling arrangement used to connect the adjacent ends of a pair of railway cars together in a substantially semipermanent fashion.

Such yoke has a body portion that includes a pair of substantially parallel upper and lower straps and a pair of vertical side post members interconnecting the upper and the lower straps. A rear end portion is spaced rearwardly of such vertical side posts in a direction of a longitudinal centerline of the yoke and is connected to rearward extremities of the upper and lower straps. The rear end portion provides a rear draft blockout seat. Forwardly extending portions of such upper and lower straps provide an upper forward portion of the yoke and a lower forward portion of the yoke. Each of the upper forward portion and the lower forward portion includes an aperture thickened portion and a nose extending forwardly of such apertured thickened portion.

An inner surface of each nose is inclined outwardly of the longitudinal centerline of the yoke. At least one of the upper and lower straps in such body portion of the yoke has a slot registrable with and adapted for reception therein of an elongated adjusting means to adjust a position of adjustable blockout device when such blockout device is mounted within a pocket of the yoke. The yoke pocket is defined by the rear draft blockout seat, the upper and lower straps and the side poet members. The forwardly extending extremities of each of the upper and the lower straps are thickened in a direction inwardly toward the longitudinal centerline of such yoke. The nose portions are reduced in thickness as compared to corresponding thickened portions by means of a step in an outer surface of the nose portions and extending across a width of the nose. Each of the nose portions have a laterally extending arcuate component retaining a thickened portion between the aperture in the thickened portion of the forward portion of such yoke and such reduced thickness nose portion.

The adjustable blockout apparatus has a pair of spaced end blocks and a pair of spaced wedge members, with the spaced wedge members being slidably connected to the spaced end blocks and with an adjustable device being provided to secure the pair of spaced wedge members together. The spaced end blocks each have a top wall, a bottom wall, a pair of end walls, a pair of side walls, and confronting end faces. The confronting end faces have an inclined surface along at least a portion thereof which extends from a respective top or bottom wall of each of the pair of end blocks towards an intermediate section thereof. The pair of spaced wedge members, which are slidably disposed between the spaced end blocks, each have a pair of side walls, an outer wall, an inner wall which confronts the inner wall of the other wedge member, and a pair of end walls which extend from the outer wall to the inner wall and which converge toward each other as they extend from the outer wall to the inner wall. An adjustable securing device adjustably secures the confronting pair of spaced wedge members together, while the spaced wedge members are also slidably connected to the pair of end blocks, with the converging end walls of the spaced wedge members contacting a respective inclined surface of a respective confronting end face of an end block. The slidable connection between the pair of spaced wedge members and the pair of spaced end blocks is preferably effected by means of outwardly extending flanges on the confronting end faces of the end blocks and a tongue or tenon provided on the end walls of the spaced wedge members and terminating in a key member at each end. The flanges and the inclined surfaces of the confronting end faces of the end blocks forming a mortise and the tongues or tenons with their associated key members foxing a tenon of a mortise and tenon connection between the end blocks and the spaced wedge members. The adjustable securing device for securing the pair of spaced wedge members together comprises coaxial threaded bores through the spaced wedge members and a threaded member extending between and through the coaxial bores and threadably engaged therewith. The bores are threaded in opposite directions and the threaded member has a threaded portion adjacent each end which is threadable with the bores, such that upon rotating the threaded member in one direction, the spaced wedge members will be moved together, to push the pair of end blocks apart, while upon rotating the threaded member in the other direction, the spaced wedge members will be moved apart to pull the pair of spaced end blocks together.

In an alternative form of adjustable securing device, only one of the spaced wedge members has a threaded bore and the threaded member has threads of one hand only to match and engage the threads of such threaded bore in the one spaced wedge member. The other spaced wedge member has an enlarged bore therethrough coaxial with the threaded bore in the one spaced wedge member. The diameter of the enlarged bore is greater than the major diameter of the threaded member to allow relatively free passage of the threaded member through the enlarged bore. A bolt head or the like on one end of the threaded member is used to retain the other wedge shaped member relative to the one wedge shaped member. When the threaded member is rotated in one direction the bolt head will move farther away from the one spaced wedge member making it possible for the other spaced wedge member to be positioned farther from the one spaced wedge member, which action allows the spaced end blocks to move closer together. When the threaded member is rotated in the other direction the spaced wedge members are drawn closer together forcing the spaced end blocks away from each other and increasing the overall length of the blockout apparatus. Expansion coil springs are positioned between the spaced wedge members to urge such spaced wedge members apart from each other to the extent permitted by the position of the threaded member. Elongated spring retainer posts are attached to the opposed surfaces of the spaced wedge members. The spring retainer posts may be arranged in axially aligned opposed pairs and fit closely within the inner diameter of the springs to help hold them in place and in axial alignment.

While both the presently preferred and alternative embodiments of the yoke of the present invention have been described in detail above, it should be obvious that various other modifications and adaptations of such invention can be made by those persons skilled in the art without departing from the spirit and scope of the appended claims.

We claim:

1. In a slackless drawbar assembly for connecting adjacent ends of a pair of railway cars together in a substantially semi-permanent manner in which said assembly includes a yoke and a yoke draft gear pocket axially adjustable blockout apparatus, the improvement comprising said yoke being characterized by:

(a) a rear end portion having a front face which forms a rear seat for said blockout device;

(b) a top strap portion having a first end thereof connected to a first end of said rear end portion, said top strap portion extending forwardly of said front face of said rear end portion of said yoke for a first predetermined length;

(c) a bottom strap portion having a first end thereof connected to a radially opposed second end of said rear end portion, said bottom strap portion extending forwardly of said front face of said rear end portion of said yoke for a second predetermined length;

(d) a top forward portion having a first end thereof connected to a radially opposed second end of said top strap portion, said top forward portion having a portion thereof which is thicker by a predetermined amount than a predetermined thickness of said top strap portion;

(e) a bottom forward portion having a first end thereof connected to a radially opposed second end of said bottom strap portion, said bottom forward portion having a portion thereof which is thicker by a predetermined amount than a predetermined thickness of said bottom strap portion, each of said top forward portion and said bottom forward portion of said yoke terminating in a reduced thickness nose portion, said nose portion having an outer surface substantially parallel to a longitudinal centerline of said yoke and an inner surface inclined outwardly of said longitudinal centerline;

(f) a first generally round aperture formed through said portion of said top forward portion which is thicker than said predetermined thickness of said top strap portion, said first generally round aperture having a predetermined diameter, said first generally round aperture receives therein a first portion of a drawbar connecting pin member;

(g) a second generally round aperture formed through said portion of said bottom forward portion which is thicker than said predetermined thickness of said bottom strap portion, said second generally round aperture having a predetermined diameter, said second generally round aperture receives therein a second radially opposed portion of said drawbar connecting pin member;

(h) a first side post member connected at a first end thereof to an inner surface of said top strap portion adjacent an outermost outer edge thereof and intermediate said first and said second end thereof and connected at a radially opposed second end thereof to an inner surface of said bottom strap portion adjacent a first outermost edge thereof and intermediate said first and said second end thereof;

(i) a second side post member positioned radially opposite said first side post member, said second side post member connected at a first end thereof to said inner surface of said top strap portion adjacent a second outermost edge thereof and connected at a radially opposed second end thereof to said inner surface of said bottom strap portion adjacent a second outermost edge thereof;

(j) each of said top strap member and said bottom strap member having a first tapered portion extending inwardly toward a vertical plane extending through a longitudinal centerline of said yoke beginning at a point adjacent a first edge of a respective one of said first and second side post members which faces said front face of said rear portion of said yoke and ending at a predetermined point adjacent said front face of said rear portion of said yoke;

(k) each of said top strap member and said bottom strap member having a second tapered portion extending inwardly toward said vertical plane extending through said longitudinal centerline of said yoke beginning at a point adjacent a second edge of said respective one of said first and second side post members which faces a respective one of said forward portion of said top strap member and said bottom strap member and ending at a point adjacent said portion thereof which is thicker;

(l) an outer edge of each of said top strap member and said bottom strap member disposed between said first edge and said second edge of a respective one of said first and second side post members being in a plane disposed substantially parallel to said vertical plane extending through said longitudinal centerline of said yoke;

(m) an aperture spaced from said front face of said rear end portion formed through at least one of said top strap portion and said bottom strap portion at a point located between said front face of said rear end portion and the location of said first and second side post members for providing access to an adjusting means to adjust an axial length of said adjustable blockout device when said adjustable blockout device is mounted within a yoke pocket defined by said front face of said rear end portion, said inner surface of said top strap portion, said inner surface of said bottom strap portion and an inner surface of each of said first side post member and said second side post member; and (n) said rear end portion and said first and second side post members providing the only connections between said top strap portion and said bottom strap portion; and said yoke draft gear pocket axially adjustable blockout apparatus being positioned within said yoke pocket defined by said front face of said rear end portion, said inner surface of said top strap portion, said inner surface of said bottom strap portion and an inner surface of each of said first side post member and said second side post member;

2. A slackless drawbar assembly, according to claim 1, wherein at least the following portions of said yoke are formed as a single piece casting: said top strap portion, said bottom strap portion, said rear end portion, said first side post member and said second side post member.

3. A slackless drawbar assembly, according to claim 2, wherein said rear end portion of said yoke includes at least one weight reducing cavity.

4. A slackless drawbar assembly, according to claim 3, wherein said rear end portion of said yoke includes a plurality of weight reducing cavities.

5. In a slackless drawbar assembly for connecting adjacent ends of a pair of railway cars together in a substantially semi-permanent manner, which assembly includes a yoke and an axially adjustable blockout apparatus, the improvement comprising said yoke having:

a body portion including a pair of substantially parallel upper and lower straps having at least two tapered portions and a pair of vertical side post members interconnecting said upper end lower straps, a rear end portions spaced rearwardly of said vertical side posts in a direction of a longitudinal centerline of said yoke and connected to rearward extremites of said upper and lower straps and having a rear draft blockout seat, and forwardly extending portions of said upper and lower straps providing an upper forward portion of said yoke and a lower forward portion of said yoke, each of said upper forward portion and said lower forward portion having an apertured thickened portion and a nose extending forwardly of said apertured thickened portion and wherein an inner surface of said nose is inclined outwardly of said longitudinal centerline of said yoke, said lower strap in said body portion of said yoke having an elongated slot formed therein intermediate said side post members and said rear draft blockout seat, said yoke having a pocket defined by said rear draft blockout seat, said upper and said lower straps and said side post members, said axially adjustable blockout apparatus including an elongated adjusting means for adjusting an axial length of said axially adjustable blockout apparatus and being adapted for mounting within said pocket of said yoke and said slot being registrable with and adapted for providing access to said elongated adjusting means when said axially adjustable blockout apparatus is mounted within said pocket of said yoke.

6. A slackness drawbar assembly, according to claim 5, wherein forwardly extending extremities of each of said upper and said lower straps of said yoke are thickened in a direction inwardly toward said longitudinal centerline of said yoke and said nose portions of said yoke are reduced in thickness as compared to corresponding thickened portions by means of a step in an outer surface of said nose and extending across a width of said nose and having a laterally-extending arcuate component retaining a thickened portion of said forward portion of said yoke and said reduced thickness nose.

7. A slackless drawbar assembly, according to claim 5, wherein an outer surface of said nose portion of each forward portion of said yoke is substantially parallel to said longitudinal centerline of said yoke.

8. A slackless drawbar assembly, according to claim 7, wherein a forwardmost extremity of each said nose portion is of generally semicircular form.

9. A slackless drawbar assembly, according to claim 5, wherein each of said upper strap and said lower strap portions of said yoke include at least two tapered portions in end to end relationship with each other and with wider portions of said tapered portions contiguous with each other.

10. In a slackless drawbar assembly for connecting adjacent ends of a pair of railway cars together in a substantially semi-permanent manner which assembly includes a yoke and a draft gear pocket axially adjustable blockout apparatus, the improvement comprising said blockout apparatus having:

(a) a pair of spaced end blocks, each end block having a top wall, a bottom wall, a pair of end walls, a pair of side walls, and confronting end faces, each of said confronting end faces having a pair of inclined surfaces along at least a portion thereof converging from said top wall and said bottom wall towards an intermediate section of said end face;

(b) a pair of first and second spaced wedge members disposed between said spaced end blocks, each of said pair of wedge members having side walls, an outer wall and an inner wall, with said inner walls confronting each other, and end walls converging from said outer wall towards said inner wall;

(c) means for slidably connecting said pair of spaced wedge members with said pair of end blocks with each of said converging end walls of said spaced wedge members contacting a said inclined surface of a confronting end face of a said end block;

(d) a first threaded bore disposed in said first wedge member and extending therethrough between said inner and outer walls thereof;

(e) a second threaded bore disposed in said second wedge member and extending therethrough between said inner and outer walls thereof and coaxially aligned with said first threaded bore and having threads of an opposite direction to the threads of said first threaded bore;

(f) a threaded member extending into said first threaded bore and said second threaded bore of said spaced wedge members, said threaded member having a head at one end, a gripping member at an opposite end, and a shank portion extending between said head and said gripping member;

(g) a first portion of said shank portion adjacent said head, having a threaded portion engageable with threads in said first threaded bore; and (h) a second portion of said shank portion, adjacent said gripping member having a threaded portion engageable with threads in said second threaded bore; and (i) whereby, upon threading of said threaded member into said threaded bores of said spaced wedge members, said pair of confronting spaced wedge members will be secured together and upon rotating said threaded member in one direction, with said spaced wedge members restrained from rotation, said pair of spaced wedge members will be moved together, while upon rotating said threaded member in an opposite direction said pair of said spaced wedge members will be moved apart.

11. A slackless drawbar assembly, according to claim 10, wherein a said end wall of one of said pair of said spaced end blocks of said draft gear pocket axially adjustable blockout apparatus has an angular surface extending at an acute angle from said bottom wall portion to said top wall portion.

12. A slackless drawbar assembly, according to claim 10, wherein both end walls of said pair of said spaced end blocks of said draft gear pocket axially adjustable blockout apparatus have an angular surface extending at an acute angle from said bottom wall portion to said top wall portion.

13. A slackless drawbar assembly, according to claim 10, wherein said first and second wedge members of said draft gear pocket axially adjustable apparatus have at least one end wall which converges from said outer wall towards said inner wall.

14. In a slackless drawbar assembly for connecting adjacent ends of a pair of railway cars together in a substantially semi-permanent manner which assembly comprises a yoke and a draft gear pocket axially adjustable blockout apparatus, the improvement comprising said blockout apparatus having:

(a) a pair of spaced end blocks, each of said pair of spaced end blocks having a top wall portions, a bottom wall portion, a pair of end wall portions, a pair of side wall portions, and confronting end faces, each said confronting end face having a pair of inclined surfaces along at least a portion thereof converging towards an intermediate section of said end face from a respective said top wall portion and from said bottom wall portion;

(b) a pair of spaced wedge shaped members disposed between said pair of said spaced end blocks, each of said pair of said spaced wedge shaped members having a pair of side wall portions, an outer wall portion and an inner wall portion, with each said inner wall portion confronting each other, and a pair of end wall portions converging from said outer wall portion towards said inner wall portion;

(c) a threaded means engageable with each of said pair of said spaced wedge shaped members for adjustably securing said confronting pair of said spaced edge shaped members together; and (d) means for slidably connecting said pair of said spaced wedge shaped members with said pair of said spaced end blocks, with each of said convering end wall portions of said spaced wedge shaped members contacting a said inclined surface of a confronting end face of a said spaced end block.

15. A slackless drawbar assembly, according to claim 14, wherein a said end wall of one of said pair of said spaced end blocks of said draft gear pocket axially adjustable blockout apparatus includes an angular surface extending at an acute angle from said bottom wall portion to said top wall portion.

16. A slackless drawbar assembly, according to claim 14, wherein a said end wall of one of said pair of said spaced end blocks of said draft gear pocket axially adjustable blockout apparatus includes an angular surface extending at an acute angle from said bottom wall portion to said top wall portion.

17. A slackless drawbar assembly, according to claim 14, wherein coaxial threaded bores are provided through each of said pair of said spaced wedge shaped members of said draft gear pocket axially adjustable blockout apparatus and wherein said means for adjustably securing said confronting pair of said spaced wedge shaped members together includes a threaded member extending between and threadably engaged with said coaxial threaded bores in said pair of said spaced wedge shaped members.

18. In a slackless drawbar assembly for connecting adjacent ends of a pair of railway cars together in a substantially semi-permanent manner which assembly comprises a yoke and a draft gear pocket axially adjustable blockout apparatus, the improvement being characterized by an adjustable securing device comprising:

(a) a first wedge shaped member having each of a horizontally disposed top wall portion and a horizontally disposed bottom wall portion, a pair of substantially vertically disposed end wall portions and a pair of tapered side wall portions extending between said top wall portion and said bottom wall portion and between said pair of said end wall portions, said top wall portion having a predetermined width which is wider than a predetermined width of said bottom wall portion;

(b) a second wedge shaped member spaced from and confronting said first wedge shaped member, said second wedge shaped member having each of a horizontally disposed top wall portion and a horizontally disposed bottom wall portion, a pair of substantially vertically disposed end wall portions and a pair of tapered side wall portions extending between said top wall portion and said bottom wall portion and between said pair of said end wall portions, said top wall portion having a predetermined width which is narrower than a width of said bottom wall portion;

(c) a first threaded bore extending between and through said top wall portion and said bottom wall portion of said first wedge shaped member, said first threaded bore having threads oriented in one of a left hand and a right hand predetermined direction;

(d) a second threaded bore extending between and through said top wall portion and said bottom wall portion of said second wedge shaped member and disposed in axial alignment with said first threaded bore, said second threaded bore having threads oriented in an opposite one of said left hand and said right hand predetermined direction of said thread in said first threaded bore; and (e) a threaded member extending into said first threaded bore of said first wedge shaped member and into said second threaded bore of said second wedge shaped member, said threaded member including, (i) a head portion disposed at a first end thereof;

(ii) a gripping member portion disposed at an axially opposed second end thereof, and (iii) a shank portion extending between said head portion and said gripping member portion, a first portion of said shank portion located adjacent said head portion, having a threaded portion engageable with said threads disposed in said first threaded bore in said first wedge shaped member and a second portion of said shank portion, located adjacent said gripping member portion, having a threaded portion engageable with said threads disposed in said second threaded bore in said second wedge shaped member so that upon threading of said threaded member into said first threaded bore in said first wedge shaped member and said second threaded bore in said second wedged shaped member, said first wedge shaped member and said second wedge shaped member will be secured together and upon rotating said threaded member in a first direction with said first wedge shaped member and said second wedge shaped member being restrained from rotation they will be moved toward one another and upon rotation of said threaded member in an opposite direction they will be moved apart.

19. In a slackless drawbar assembly for connecting adjacent ends of a pair of railway cars together in a substantially semi-permanent manner which assembly includes a yoke and a draft gear pocket axially adjustable blockout apparatus, the improvement being characterized by an adjustable securing device comprising:

(a) a first wedge shaped member having each of a horizontally disposed top wall portion, a horizontally disposed bottom wall portion, a pair of substantially vertically disposed end wall portions in which vertically oriented outer edges thereof converge towards each other from said top wall portion to said bottom wall portion and a pair of tapered side wall portions extending between said top wall portion and said bottom wall portion and between said pair of said end wall portions;

(b) a second wedge shaped member spaced from and confronting said first wedge shaped member, said second wedge shaped member having each of a horizontally disposed top wall portion and a horizontally disposed bottom wall portion, a pair of substantially vertically disposed end wall portions in which vertically oriented outer edges thereof converge towards each other from said bottom wall portion to said top wall portion and a pair of tapered side wall portions extending between said top wall portion and said bottom wall portion and between said pair of said end wall portions;

(c) a first threaded bore extending between and through said top wall portion and said bottom wall portion of said first wedge shaped member, said first threaded bore having threads oriented in one of a left hand and a right hand predetermined direction;

(d) a second threaded bore extending between and through said top wall portion and said bottom wall portion of said second wedge shaped member, and disposed in axial alignment with said first threaded bore, said second threaded bore having threads oriented in an opposite one of said left hand and said right hand predetermined direction of said threads in said first bore; and (e) a threaded member extending into said first threaded bore of said first wedge shaped member and into said second threaded bore of said second wedge shaped member, said threaded member including, (i) a head portion disposed at a first end thereof, (ii) a gripping member portion disposed at an axially opposed second end thereof, and (iii) a shank portion extending between said head portion and said gripping member portion, a first portion of said shank portion, located adjacent said head portion, having a threaded portion engageable with said threads disposed in said first threaded bore in said first wedge shaped member and a second portion of said shank portion, located adjacent said gripping member portion, having a threaded portion engageable with said threads disposed in said second threaded bore in said second wedge shaped member so that upon threading of said threaded member into said first threaded bore in said first wedge shaped member and into said second threaded bore in said second wedge shaped member, said first wedge shaped member and said second wedge shaped member will be secured together and upon rotating said threaded member in a first direction with said first wedge shaped member and said second wedge shaped member being restrained from rotation they will be moved toward one another and upon rotation of said threaded member in an opposite direction they will be moved apart.

* * * * *

UNITED STATES PATENT AND TRADEMARK OFFICE

CERTIFICATE OF CORRECTION

PATENT NO. : 5,339,970

DATED : August 23, 1994

INVENTOR(S) : Peter S. Mautino et al

It is certified that error appears in the above-indentified patent and that said Letters Patent is hereby corrected as shown below:

Column 1, line 60, delete "-" and insert --.--;
column 1, line 60, delete "con,non" and insert --common--.
Column 4, line 64, delete "-" and insert --.--.
Column 5, line 12, delete "forths" and insert --forms--.
Column 7, line 56, delete "men%bets" and insert --members--;
column 7, line 59, delete "men%her" and insert --member--.
Column 8, line 21, delete "men%hers" and insert --members--;
column 8, line 64, delete "-" and insert --.--;
column 8, line 64, delete "men%her" and insert --member--.
Column 9, line 49, delete "men,her" and insert --member--.
Column 14, line 37, delete "men%her" and insert --member--.
Column 15, line 3, delete "men,pets" and insert --members--.
Column 17, line 16, delete "men%her" and insert --member--;
column 17, line 43, insert --228-- after pocket.
Column 19, line 9, delete "poet" and insert --post--;
column 19, line 55, delete "foxing" and insert --forming--.
Column 22, line 48, delete "end" and insert --and--;

UNITED STATES PATENT AND TRADEMARK OFFICE

CERTIFICATE OF CORRECTION

PATENT NO. : 5,339,970

DATED : August 23, 1994

INVENTOR(S) : Peter S. Mautino et al

It is certified that error appears in the above-indentified patent and that said Letters Patent is hereby corrected as shown below:

column 22, line 49, delete "portions" and insert --portion--.
Column 24, line 46, delete "portions" and insert --portion--.

Signed and Sealed this

Fifteenth Day of November, 1994

*Attest:*

*Attesting Officer*

BRUCE LEHMAN

*Commissioner of Patents and Trademarks*